United States Patent [19]

White et al.

[11] Patent Number: 4,637,211

[45] Date of Patent: Jan. 20, 1987

[54] APPARATUS AND METHOD FOR CONVERTING THERMAL ENERGY TO MECHANICAL ENERGY

[76] Inventors: Dowell White, Pasadena; Daniel L. Craig; Jack L. Duke, both of Houston; Donald H. Laurie, Porter, all of Tex.

[21] Appl. No.: 761,600

[22] Filed: Aug. 1, 1985

[51] Int. Cl.[4] ..... F01K 25/02

[52] U.S. Cl. ..... 60/650; 60/682

[58] Field of Search ..... 60/650, 682

[56] References Cited

U.S. PATENT DOCUMENTS

| | | | |
|---|---|---|---|
| 1,032,236 | 7/1912 | Patten | 60/650 |
| 4,183,220 | 1/1980 | Shaw | 60/650 |
| 4,283,915 | 8/1981 | McConnell | 60/650 |

FOREIGN PATENT DOCUMENTS

| | | | |
|---|---|---|---|
| 2448985 | 4/1976 | Fed. Rep. of Germany | 60/650 |

*Primary Examiner*—Allen M. Ostrager

*Attorney, Agent, or Firm*—Vinson & Elkins

[57] ABSTRACT

An apparatus and method for converting thermal energy to mechanical energy utilizing a heat engine having a liquid working fluid which remains in liquid state in a closed fluid system throughout the entire cycle. The closed fluid system for the liquid working fluid includes a pair of double acting displacer cylinders (18, 20) in opposed cycling relation to each other and alternating between low pressure working fluid and high pressure working fluid. High temperature high pressure working fluid from a heat exchanger (12) including a plurality of thin heat transfer plates is provided alternately to the cylinders (18, 20) by the actuation of control valves (24, 28). The heat exchanger (12), a heater (14), and a cooler (16) are arranged between the control valves (24, 28) and the flow of low pressure working fluid and high pressure working fluid in adjacent paths through the heat exchanger (12) between the control valves (24, 28) is always in the same direction for each path.

42 Claims, 26 Drawing Figures

APPARATUS AND METHOD FOR CONVERTING THERMAL ENERGY TO MECHANICAL ENERGY

BACKGROUND OF THE INVENTION

This invention relates to an apparatus and method for converting thermal energy to mechanical energy utilizing a liquid working fluid which remains in liquid state in a closed fluid system throughout the entire cycle.

Heretofore, such as shown in U.S. Pat. Nos. 1,487,664 dated March 18, 1924 and 1,717,161 dated June 11, 1929, both to John F. J. Malone, a so-called Malone-type heat engine has been developed utilizing a liquid working fluid or thermodynamic medium. The heat engine shown by Malone has a heat exchanger or regenerator in which a liquid working fluid always flows in the same direction therethrough.

In a heat exchanger in which the working fluid is a liquid always flowing in the same direction, the quantity of liquid inside the heat exchanger is greater than the quantity of liquid outside the heat exchanger. When liquids move through efficient heat exchangers, an unusually high heat transfer efficiency is obtained as heat transfer elements heat and cool liquids quickly with a relatively small percentage of heat loss. Further, the expansion of liquids is greater than their compressibility which permits a relatively large change of pressure with a relatively small change in temperature. The maximum temperature of a liquid working fluid is substantially below the critical temperature as liquids near the critical temperature are very easily compressed.

U.S. Pat. No. 4,209,982 dated July 1, 1980 to Clyde T. Pitts discloses a fluid energy conversion system in which two opposed cylinders have a liquid working fluid therein and utilize Freon 11 as a second fluid for operation of the opposed cylinders. The Freon is utilized as a gaseous fluid in the cylinders and is mixed or used in combination with the working fluid which is water. A turbine is powered by the working fluid and may in turn, be used to drive an electrical generator or an irrigation pump. Thus, a conversion system is shown in which the thermal energy from the working fluid is utilized for driving a mechanical power output.

U.S. Pat. No. 4,283,915 dated August 18, 1981 to David P. McConnell is directed to a system for converting the thermal energy of warm water which is used as the working fluid into a high pressure hydraulic output flow utilized for driving a hydraulic motor. Banks of heat exchangers utilizing a plurality of heat exchange tubes and fluid pressure accumulators are connected to the output of the heat exchanger for driving a hydraulic motor.

SUMMARY OF THE INVENTION

This invention is particularly adapted to an apparatus and method that utilizes a liquid in a closed system as the working fluid in a heat engine for converting thermal energy to mechanical energy. The closed fluid system for the liquid working fluid includes a pair of displacer cylinders in opposed cycling relation to each other and alternating between low pressure working fluid and high pressure working fluid, one cylinder receiving and displacing low pressure working fluid and the other cylinder simultaneously receiving and discharging high pressure working fluid, thereby to provide a continuous displacement of high pressure working fluid and low pressure working fluid from the pair of cylinders in alternating relation. High pressure working fluid from a heat exchanger is provided alternately to the pair of displacer cylinders and is utilized for the power stroke of the displacer cylinders and/or power means for generating mechanical energy.

The heat exchanger comprises a plurality of generally rectangular plates secured to each other in fluid-tight abutting relation with separate flow paths therethrough for high pressure working fluid and low pressure working fluid. The heat exchanger receives high temperature low pressure working fluid and low temperature high pressure working fluid, and discharges low temperature low pressure working fluid and high temperature high pressure working fluid. For example, the high temperature low pressure working fluid entering the heat exchanger may be at a pressure under four hundred (400) psi, and a high temperature of around 180° F., while the low temperature high pressure working fluid enters the heat exchanger at a temperature of around 75° F., for example, and a pressure over around three thousand (3000) psi. The low pressure working fluid leaves the heat exchanger at a low temperature of around 80° F. with a pressure decrease of around fifty (50) psi, for example, while the high pressure working fluid is discharged from the heat exchanger at a temperature of around 178° F. and a pressure drop of around fifty (50) psi. Thus, a transfer of heat from the low pressure working fluid is made to the high pressure working fluid in the heat exchanger with the high pressure working fluid leaving the heat exchanger at a temperature slightly below the temperature at which the low pressure working fluid entered the heat exchanger. A liquid working fluid having a relatively low compressibility and a high thermal expansion is desirable. A liquid working fluid which has been found to be satisfactory is a fluorocarbon liquid designated as "Freon 12".

A separate fluid system comprising hydraulic fluid is provided as a source of power to assist in driving the displacer cylinders for the working fluid. The separate hydraulic fluid pressure system utilizes hydraulic fluid cylinders to supplement the high pressure working fluid in driving the displacer cylinders, and a portion of the hydraulic fluid system is pressurized by the high pressure working fluid to drive a hydraulic fluid motor for generating mechanical energy. This is accomplished by a fluid accumulator which receives the working fluid on one side thereof and hydraulic fluid on the other side thereof to provide a means for transmitting the pressure from the high pressure working fluid to the hydraulic fluid for effecting the driving of the hydraulic fluid motor from the high pressure working fluid.

It is an object of this invention to provide an apparatus and method utilizing a liquid working fluid in a closed fluid system in a heat engine for converting thermal energy to mechanical energy with the working fluid remaining in a liquid state throughout a complete cycle of the heat engine.

It is a further object to provide in such an apparatus and method a heat exchanger which has separate flow paths therethrough for high pressure working fluid and low pressure working fluid with the heat exchanger receiving high temperature low pressure working fluid and low temperature high pressure working fluid, and discharging low temperature low pressure working fluid and high temperature high pressure working fluid. The temperature of the high pressure working fluid being discharged is only slightly less than the temperature of the high temperature low pressure working fluid entering the heat exchanger, thereby to provide a highly effective heat transfer relation between the low pressure working fluid and the high pressure working fluid.

An additional object of this invention is to provide in such an apparatus and method a hydraulic fluid pressure system separate from the working fluid system with the hydraulic fluid system providing supplemental power to reciprocate the displacer cylinders and providing fluid pressure means responsive to the high pressure working fluid for driving a hydraulic motor which provides mechanical energy.

A further object is to provide between a pair of three-way valves a heat exchanger having a heater on one side thereof in fluid communication with one three-way valve and a cooler on the other side thereof in fluid communication with the other three-way valve with liquid working fluid heated in one direction through the heat exchanger and heater and cooled in the other opposite direction through the heat exchanger and cooler, thereby providing a highly efficient heat transfer arrangement.

Another object is to provide in such a method and apparatus a means responsive to the power stroke of the displacer cylinders and operatively connected to the displacer cylinders for producing mechanical energy.

An additional object is to utilize in such a heat transfer system a heat pump to transfer heat energy from cooling means or ambient to heating means for the heat exchanger, the heat pump being operated from a portion of the mechanical energy generated by the heat engine.

The invention accordingly comprises the features of construction, a combination of elements, and arrangements of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying panying drawings in which.

Similar reference characters refer to similar parts throughout the detailed views of the drawings.

DETAILED DESCRIPTION OF THE PREFERRED EMBODIMENT

Figure 1:
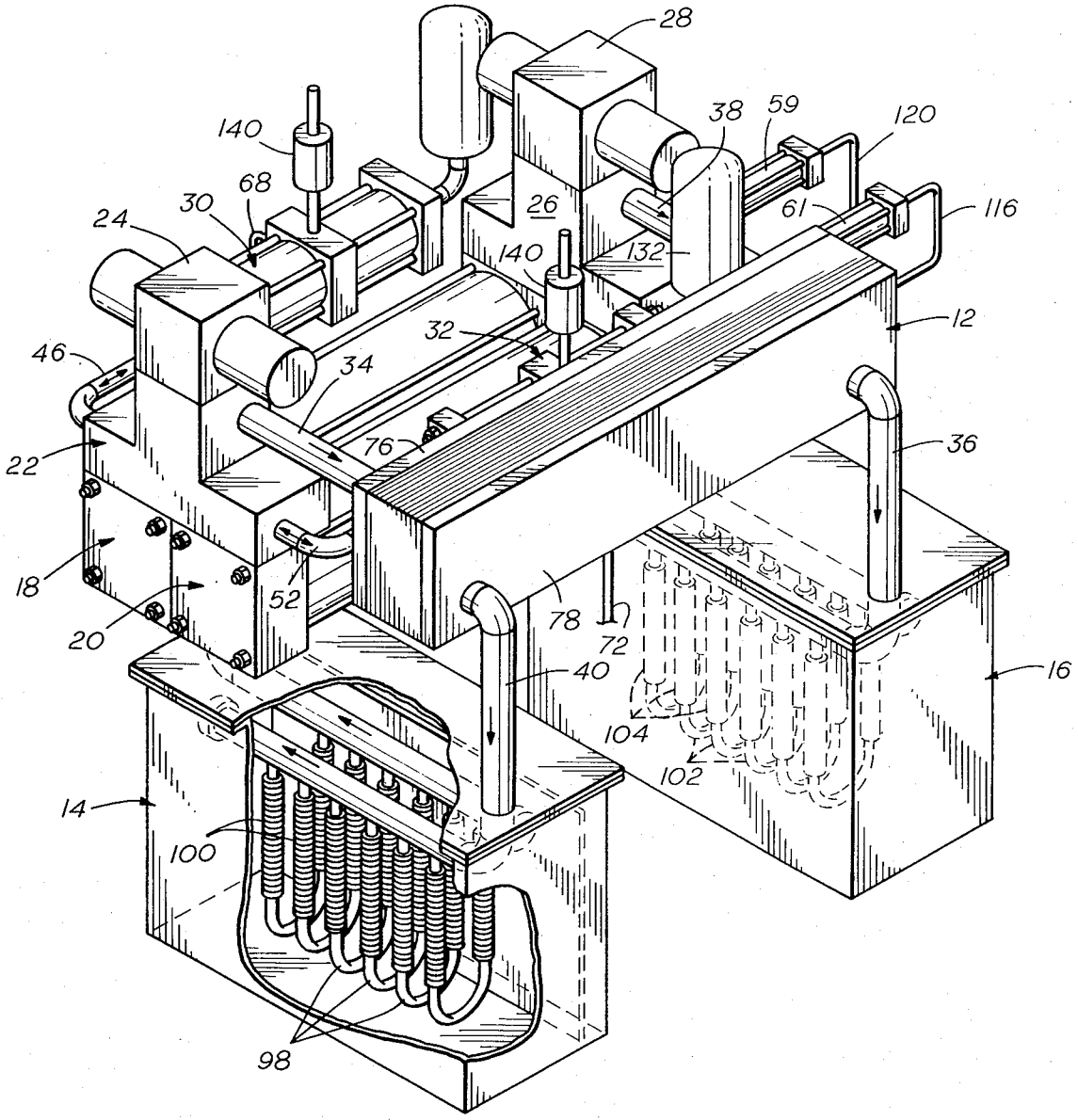
FIG. 1 is a perspective of the apparatus of the present invention comprising a heat engine to convert thermal energy to mechanical energy utilizing a liquid working fluid in a closed system.
Figure 2:
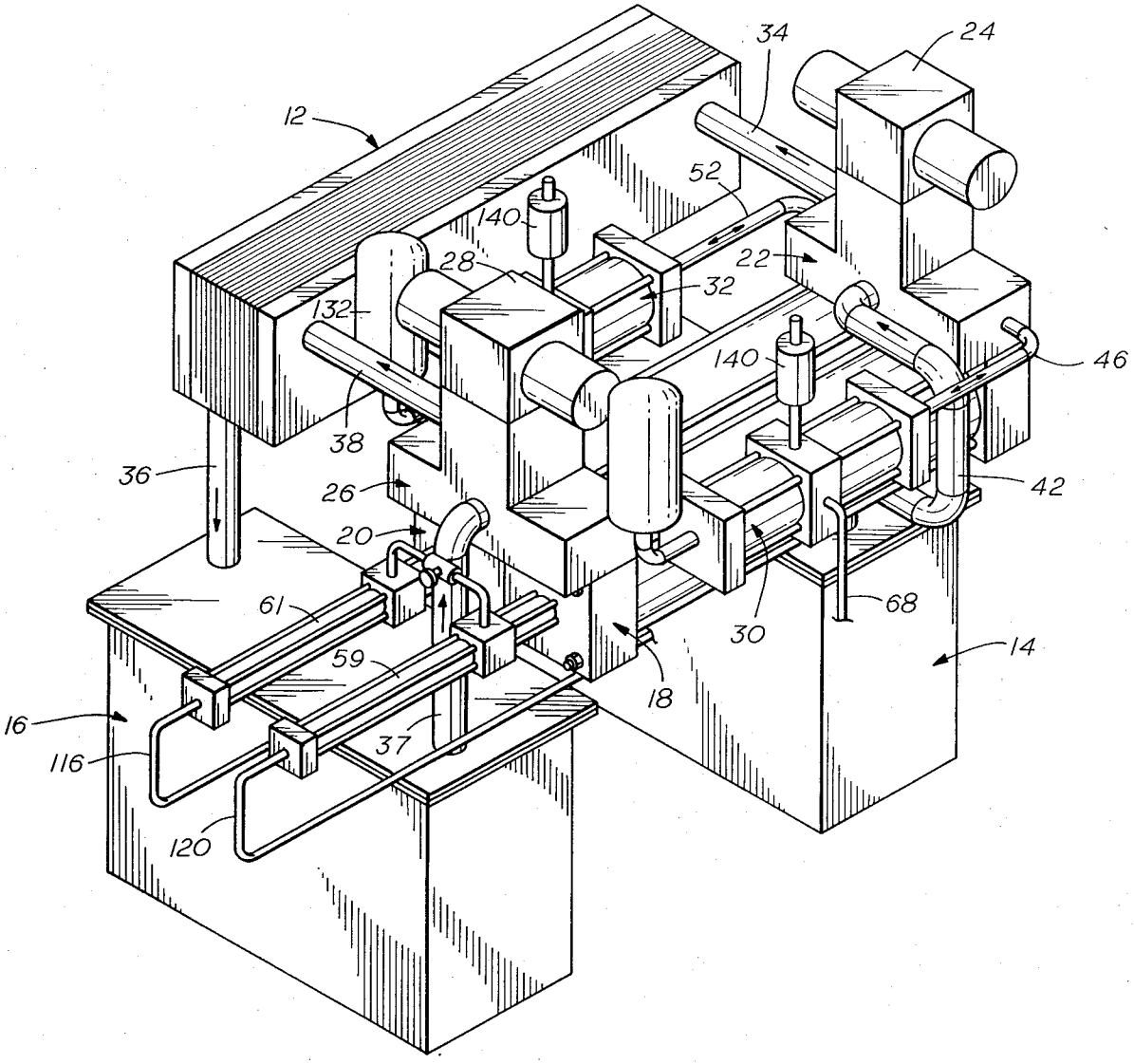
FIG. 2 is a perspective view similar to FIG. 1 but taken from the opposite side of the apparatus shown in FIG. 1.

Referring now to the drawings for a better understanding of our invention and more particularly to FIGS. 1, 2, and 4–8, the apparatus for converting thermal energy to mechanical energy is shown in FIGS. 1 and 2, and the method for converting thermal energy to mechanical energy by such apparatus is illustrated schematically in FIGS. 4–8. The apparatus comprises a heat engine generally designated at 10. Heat engine 10 includes a heat exchanger generally designated 12, a heater or heating element generally designated 14, a cooler or cooling element generally designated 16, and a pair of displacer cylinders generally designated 18 and 20. Cylinders 18 and 20 are arranged in side-by-side relation for operation in opposed cycles to receive and displace liquid working fluid in a closed fluid system.

A working fluid manifold generally designated 22 and an associated three-way valve 24 is arranged adjacent one end of displacer cylinders 18 and 20. Another working fluid manifold generally indicated 26 and having an associated three-way valve 28 thereon is positioned adjacent the other end of displacer cylinders 18 and 20. Three-way valves 24 and 28 are provided to reverse the flow of working fluid into and out of displacer cylinders 18 and 20, as will be explained.

A fluid accumulator generally indicated at 30 is provided in association with displacer cylinder 18 and a separate fluid accumulator generally indicated 32 is provided in association with displacement cylinder 20. Accumulators 30 and 32 provide an interface between the working fluid system and the hydraulic fluid system with separate chambers therein for the working fluid and the hydraulic fluid separated by a piston as will be explained. The working fluid transmits fluid pressure to the hydraulic fluid through accumulators 30 and 32, and the pressurized hydraulic fluid is utilized to power the means providing or generating mechanical energy, such as a hydraulic motor 33, for example.

All of the elements set forth above for heat engine 10 and the associated method are utilized in the working fluid system in which the working fluid flows in a low pressure path and a separate high pressure path. The working fluid system is shown in solid lines in FIGS. 4–8, while the hydraulic fluid system is shown in broken lines. The temperature and pressure of the working fluid is dependent on the particular working fluid employed. Since the working fluid is maintained in a liquid state throughout the entire operating cycle, the temperature of the working fluid is below the critical temperature of the specific working fluid employed and preferably around 50° F. below the critical temperature at which the working fluid changes from a liquid state to a gaseous or vapor state.

The closed fluid system for the working fluid will first be described utilizing the elements set forth above. First, it is noted that the separate paths of the low pressure working fluid and the high pressure working fluid through heat exchanger 12, heater 14, and cooler 16 between three-way valves 24 and 28 do not change and are in the same direction throughout the entire cycle of operation. However, the flow of low pressure working fluid and high pressure working fluid to displacer cylinders 18 and 20 is reversed at the midpoint of the cycle by three-way valves 24 and 28 which may be operated by suitable solenoids at predetermined intervals as well known in the art.

Low pressure working fluid from valve 24 enters heat exchanger 12 through low pressure line 34 and exits heat exchanger 12 through low pressure line 36 for entering cooler 16. High pressure working fluid through valve 28 enters heat exchanger 12 through high pressure working fluid line 38 and leaves heat exchanger 12 through high pressure line 40 for entering heater 14. High pressure working fluid leaves heater 14 at line 42 for return to three-way valve 24. Low pressure working fluid leaves cooler 16 through line 37 for return to three-way valve 28. Thus, the flow of low pressure working fluid and high pressure working fluid through heat exchanger 12 and between three-way valves 24 and 28 is continuous and always in the same direction of flow.

High temperature low pressure working fluid enters heat exchanger 12 along one path of travel and low temperature high pressure working fluid enters the heat exchanger 12 along a separate adjacent path. A transfer of heat occurs in heat exchanger 12 from the low pressure fluid to the high pressure fluid. The high pressure working fluid leaves heat exchanger 12 at a high temperature and the low pressure working fluid leaves the heat exchanger 12 at a low temperature. High temperature high pressure working fluid leaving heat exchanger 12 flows into heater 14 for a slight increase in temperature, while low pressure fluid leaving heat exchanger 12 flows into cooler 36 for a small reduction in temperature to maintain a desired temperature differential.

The flow of high pressure working fluid and low pressure working fluid from three-way valves 24 and 28 to displacer cylinders 18 and 20 is reversed during each cycle for supplying low pressure fluid alternately to cylinders 18 and 20, and supplying high pressure fluid alternately to cylinders 18 and 20 during each complete cycle. Working fluid line 43 extends between three-way valve 28 and one end of displacer cylinder 18 and fluid line 44 extends between the other end of displacer cylinder 18 and three-way valve 24. A branch line 46 extends between fluid line 44 and accumulator 30.

Fluid line 48 extends between three-way valve 28 and one end of displacer cylinder 20 and flow line 50 extends from the other end of displacer cylinder 20 and three-way valve 24. A branch flow line 52 extends between line 50 and accumulator 32. Displacer cylinders 18 and 20 have respective pistons 54 and 56 therein mounted for reciprocal movement with respective piston rods 58 and 60 secured at one end thereto. The other ends of piston rods 58 and 60 are received within respective hydraulic fluid cylinders 59 and 61 which aid in powering displacer cylinders 18 and 21 along with the working fluid. Respective faces 62 and 63 of pistons 54 and 56 are of a larger surface area than opposed respective faces 64 and 65 as respective piston rods 58 and 60 decrease the effective surface areas of faces 64 and 65. Thus, fluid pressure acting against faces 62 and 63 will tend to urge pistons 54 and 56 in the direction of piston rods 58 and 60 as a result of the area differential. Hydraulic flow line 68 to accumulator 30 and hydraulic flow line 72 to accumulator 32 extend to hydraulic fluid motor 33 for driving motor 33. A separate hydraulic fluid system including motor 33 is provided from a hydraulic reservoir 74 and hydraulic fluid is supplied to hydraulic cylinders 59 and 61 and accumulators 30 and 32 as will be explained further below.

Operation

Figure 5:
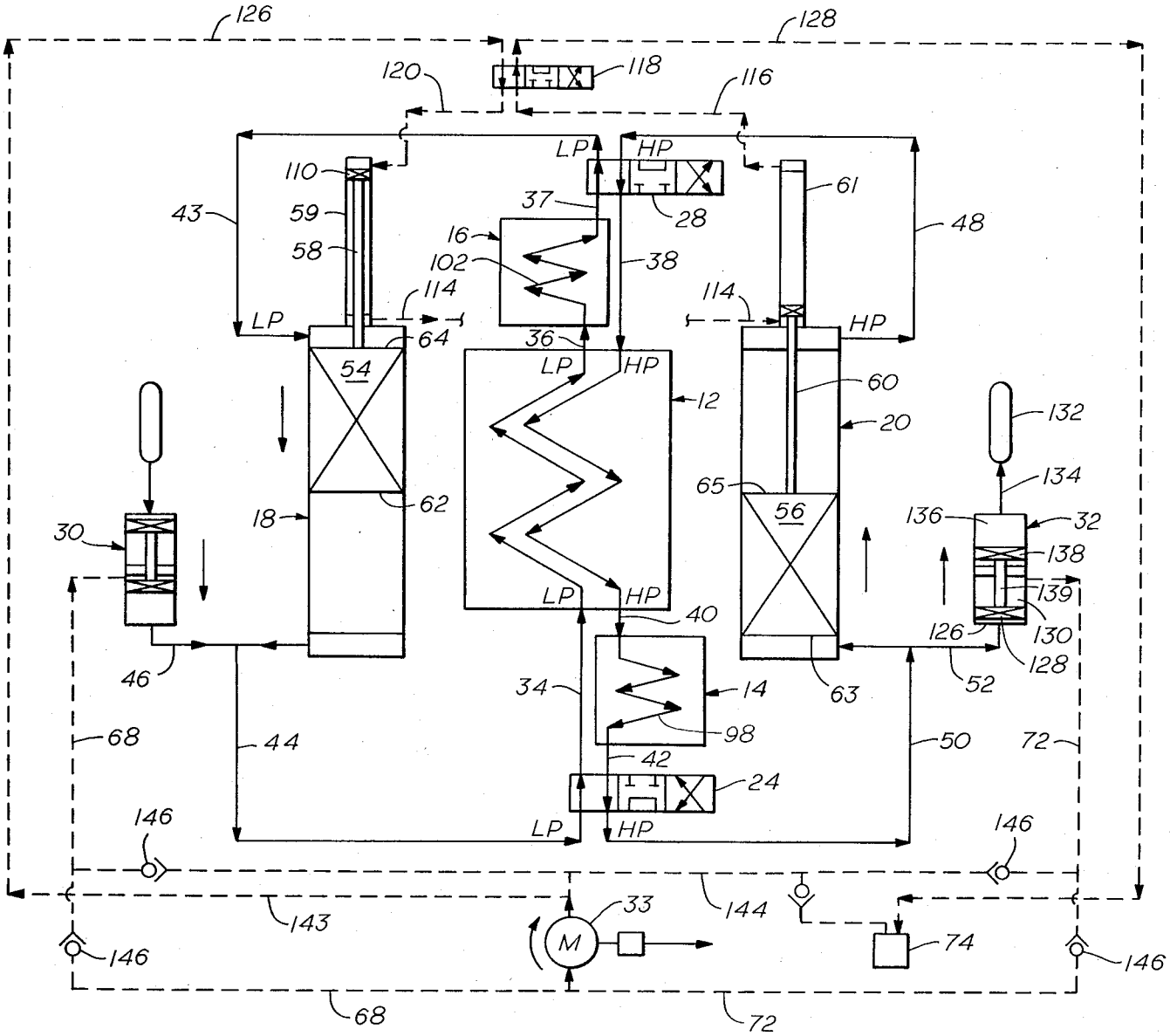
FIG. 5 is a simplified schematic of the flow diagram shown in FIG. 4 with the displacer cylinders shown in the position at the beginning of a cycle.
Figure 6:
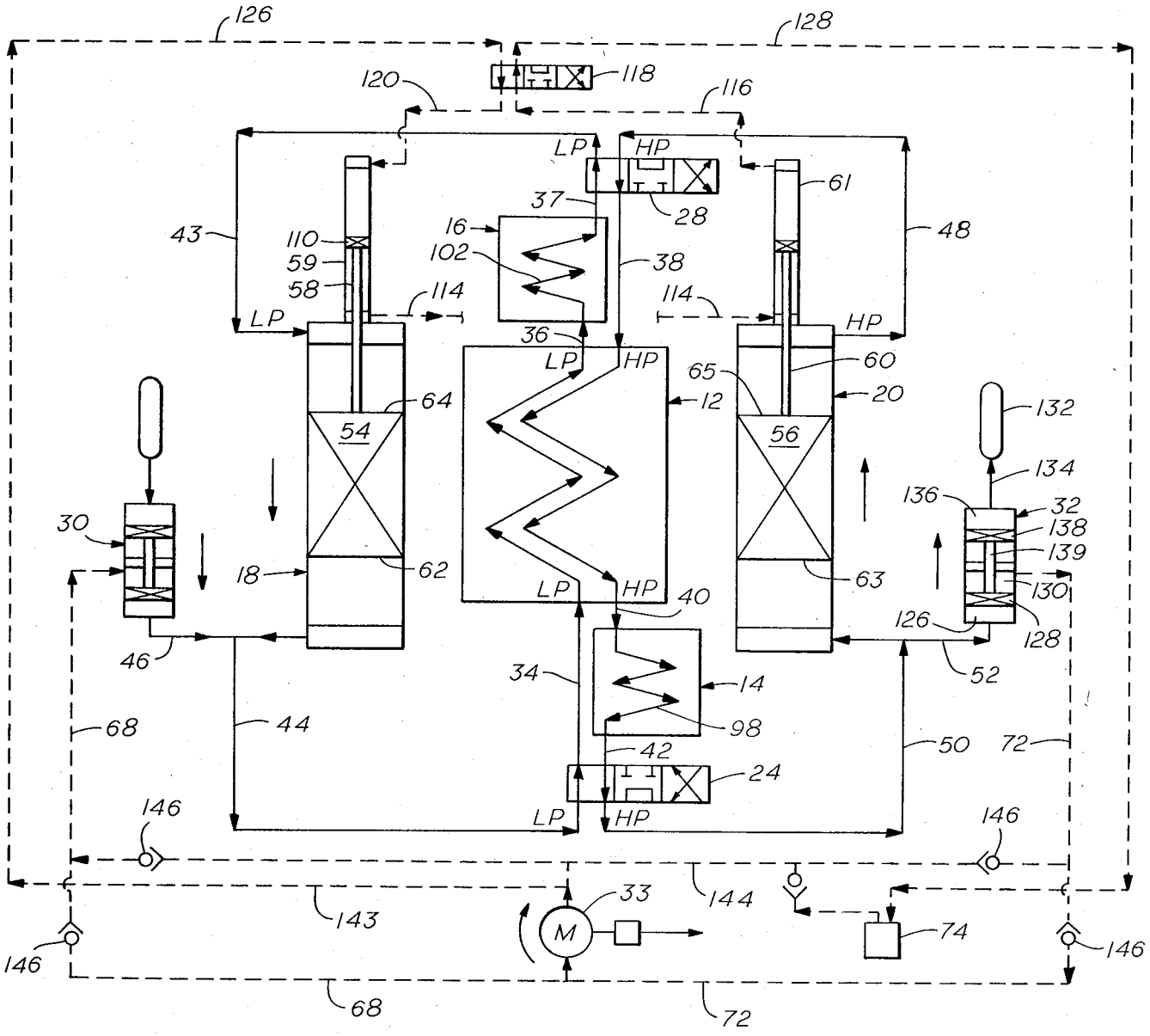
FIG. 6 is a simplified schematic similar to FIG. 5 but showing the displacer cylinders at the first quarter phase of the cycle.
Figure 7:
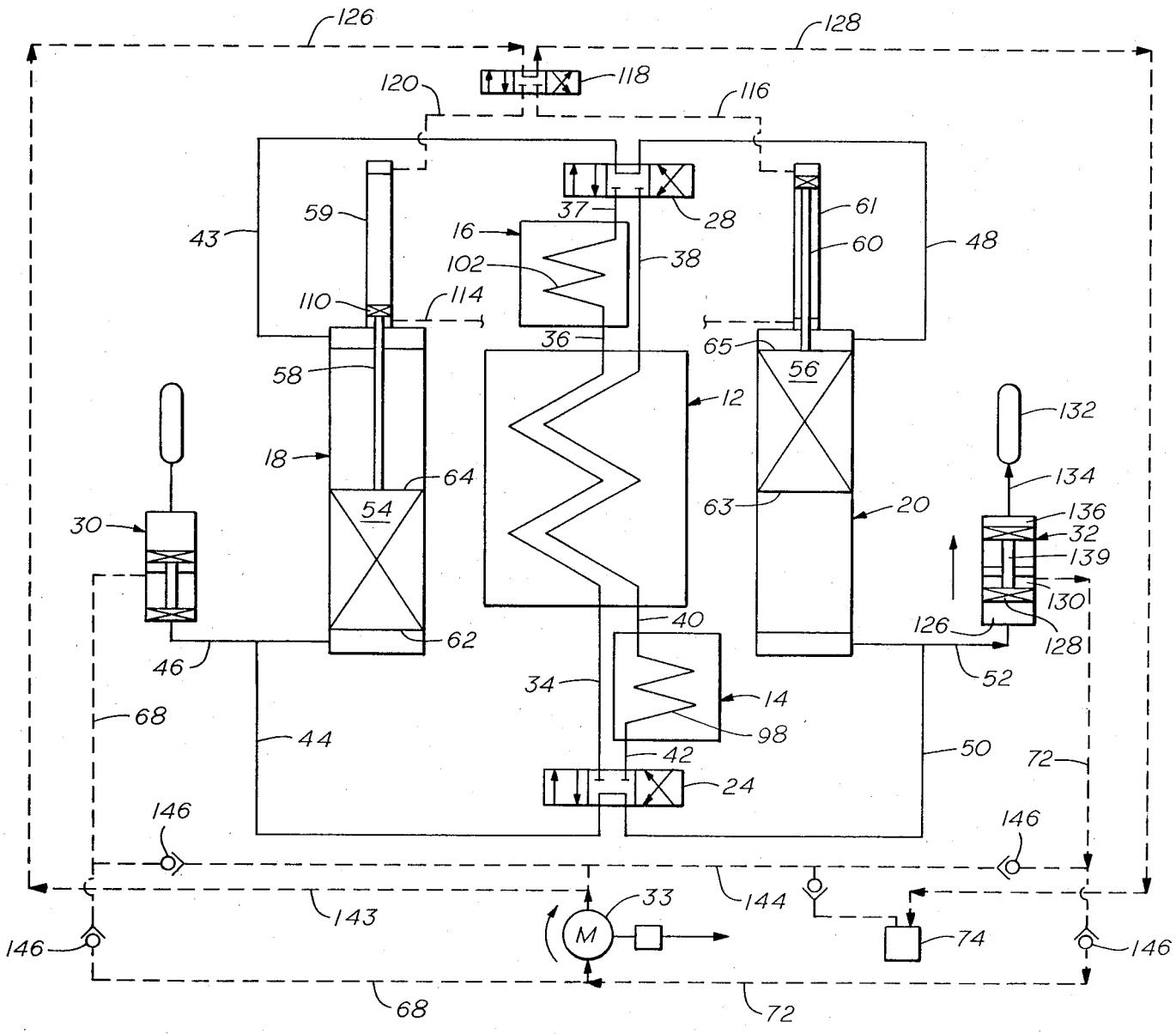
FIG. 7 is a schematic similar to FIGS. 5 and 6 but showing the displacer cylinders at the second quarter phase of the cycle with the flow of working fluid to the displacer cylinder being reversed.
Figure 8:
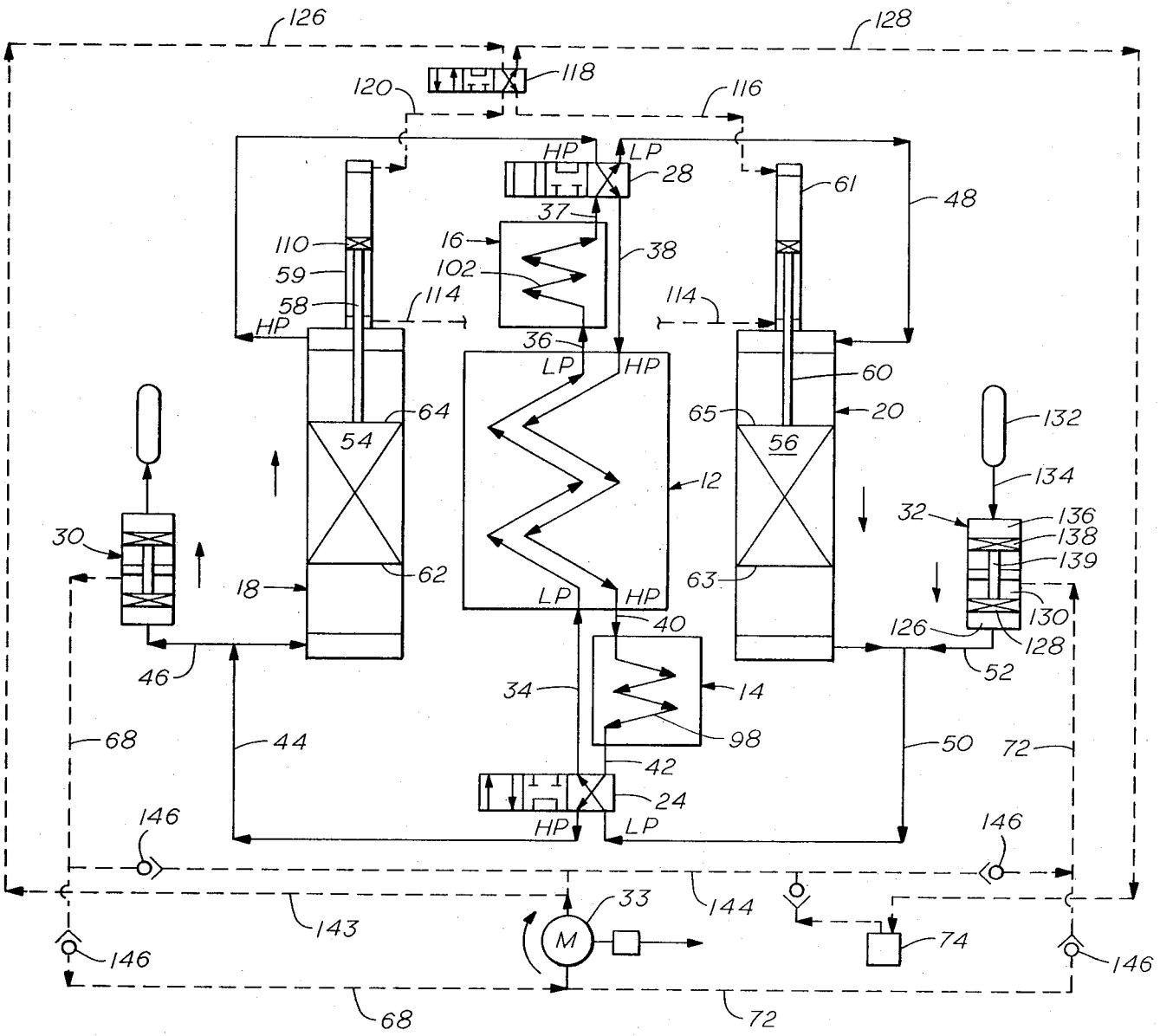
FIG. 8 is a schematic similar to FIGS. 5–7 but showing the displacer cylinders at the third quarter phase of the cycle with the flow of high pressure fluid and low pressure fluid reversed and the pistons in the cylinders moving in a direction opposite the direction shown in FIG. 6.

Referring now particularly to FIGS. 5–8 in which an entire cycle of heat engine 10 is shown schematically; with FIG. 5 showing the start of the cycle; FIG. 6 showing the end of the first quarter phase of the cycle; FIG. 7 showing the end of the second quarter phase with the fluid system through heat exchanger 12 closed momentarily prior to a reversal of flow in the low pressure and high pressure working fluid lines to displacer cylinders 18 and 20; and FIG. 8 showing the end of the third quarter phase after reversal of the flow of low pressure working fluid and high pressure working fluid to cylinders 18 and 20.

Start of Cycle—FIG. 5

Figure 4:
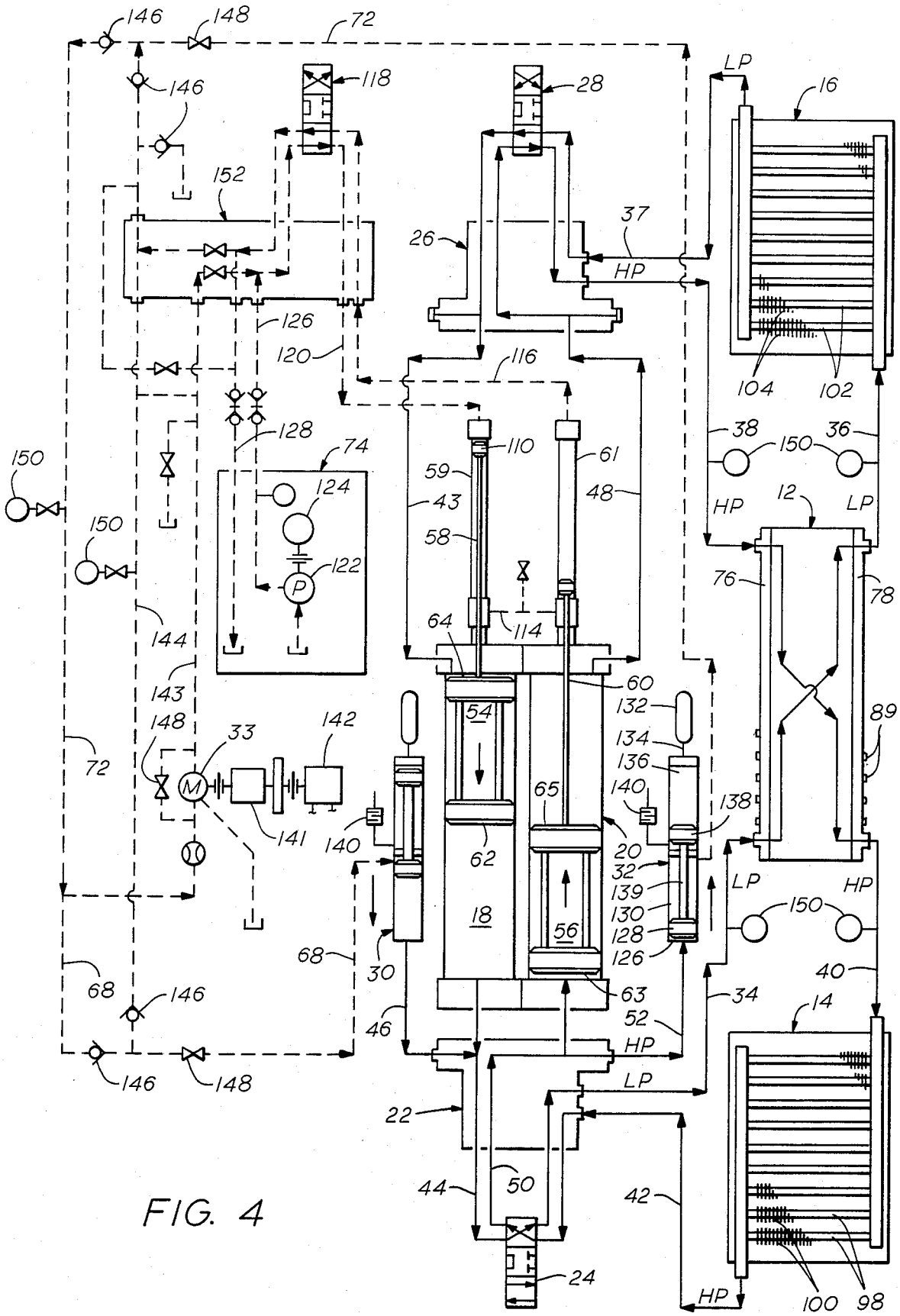
FIG. 4 is a flow diagram of both the working fluid system and the separate hydraulic fluid system, the liquid working fluid being shown in solid lines and the separate hydraulic fluid system being shown in broken lines.

Beginning at the start of the cycle as shown in FIG. 5, and also as shown in FIG. 4, displacer piston 54 in an extreme upward position is commencing to move downwardly, forcing high temperature low pressure working fluid out of cylinder 18 and through three-way valve 24 into heat exchanger 12. The low pressure working fluid leaves heat exchanger 12 at a low temperature and passes into cooler 16, and then is returned through three-way valve 28 and line 43 into the end of cylinder 18 adjacent face 64 of piston 54.

At the same time, the high temperature working fluid from line 50 moves piston 56 upwardly in the power stroke of cylinder 20 forcing low temperature high pressure working fluid from cylinder 20 through line 48 and three-way valve 28 to heat exchanger 12 where a heat transfer occurs from the low pressure working fluid to the high pressure working fluid to raise the low temperature of the high pressure working fluid to a high temperature. After leaving heat exchanger 12 the high pressure working fluid enters heater 14 through line 40 and is heated further therein. Thus, the high temperature high pressure working fluid through line 50 powers cylinder 20 and also powers accumulator 32 through branch line 52. Accumulator 32 acts as a pump to force hydraulic fluid therefrom through fluid line 72 for driving fluid motor 33 which produces mechanical energy. The displacement of piston 56 by the high pressure working fluid forces working fluid throughout the high pressure (HP) fluid lines while the displacement of piston 54 by low pressure working fluid supplemented by hydraulic cylinder 59 forces low pressure fluid throughout the low pressure (LP) fluid lines for the working fluid.

First Quarter Phase—FIG. 6

FIG. 6 shows displacer pistons 18 and 20 with displacer cylinder 20 in its intermediate power stroke forcing low temperature high pressure working fluid through heat exchanger 12, heater 14, and three-way valve 24, for return to displacer cylinder 20 at a high temperature high pressure. High temperature high pressure working fluid is likewise supplied to accumulator 32 for pushing or pumping hydraulic fluid through hydraulic fluid line 72 for driving hydraulic fluid motor 33.

Displacer cylinder 18 in the second quarter phase shown in FIG. 6 forces high temperature low pressure working fluid from cylinder 18 through line 44, three-way switch 24, and line 34 into heat exchanger 12 where the temperature is reduced by a heat transfer to the high pressure fluid. After leaving heat exchanger 12 the low pressure working fluid flows to cooler 16 through line 36 and after leaving cooler 16 is returned through line 43 to displacer cylinder 18. The low pressure working fluid on accumulator 30 through line 46 causes a flow of hydraulic fluid into accumulator 30 through line 68 as the hydraulic fluid is at a higher pressure than the low pressure working fluid.

End of Second Quarter Phase—FIG. 7

In the position of FIG. 7, it is noted that three-way valves 24 and 28 are closed so that there is no flow of low pressure working fluid and high pressure working fluid from heat exchanger 12 to displacer cylinders 18 and 20. However, it is noted that valves 24 and 28 permit a flow of working fluid between cylinders 18 and 20 to equalize pressures therein immediately prior to the reversal of fluid flow to cylinders 18 and 20. Thus, the position shown in FIG. 7 is a momentary position. Cylinder 20 is shown at the end of its power stroke with displacer cylinder 18 shown immediately prior to alternating the flow of working fluid to cylinders 18 and 20 and the beginning of the power stroke for cylinder 18 and the supplying of high temperature high pressure working fluid thereto. The fluid pressure of displacer cylinder 20 is reduced and the fluid pressure of displacer cylinder 18 is increased as the fluid pressure in the fluid chambers adjacent faces 64 and 65 of pistons 54 and 56 is equalized, and the fluid pressure in the fluid chambers adjacent faces 62 and 63 of pistons 54 and 56 is equalized. However, high temperature working fluid is provided throughout the entire cycle in the fluid chambers adjacent faces 62 and 63 while low temperature working fluid is provided throughout the entire cycle in the fluid chambers adjacent faces 64 and 65. Faces 64 and 65 as previously noted have a smaller surface area than faces 62 and 63, thereby providing a differential area exposed to fluid pressure.

Third Quarter Phase—FIG. 8

FIG. 8 shows three-way valves 24 and 28 in a position reversing the flow of low pressure working fluid and high pressure working fluid to cylinders 18 and 20 with low temperature low pressure working fluid being provided to displacer cylinder 20 and high temperature high pressure working fluid being supplied to displacer cylinder 18 for driving displacer cylinder 18 in a power stroke. High temperature high pressure working fluid from heat exchanger 12 is supplied through line 44 to displacer cylinder 18 and supplied through branch line 46 to accumulator 30 to move accumulator 30 in its power stroke upwardly as shown in FIG. 8 to pressurize hydraulic fluid through line 68 for driving hydraulic fluid motor 33. Low pressure low temperature working fluid supplied to displacer cylinder 20 through line 48 moves displacer cylinder 20 downwardly. The low pressure working fluid in line 50 and branch line 52 is at a lower pressure than the pressure of the hydraulic fluid in line 72 and as a result the hydraulic fluid causes downward movement of accumulator 32 with low pressure working fluid flowing from branch line 52 into line 50, and then through valve 24 for return to heat exchanger 12 at a high temperature low pressure.

From the above it is understood that the high pressure high temperature working fluid leaving heat exchanger 12 and heater 14 provides the power necessary for driving means to produce mechanical energy. As shown in FIGS. 5—8, the high pressure working fluid is supplied alternately to displacer cylinders 18 and 20 which provide the power for effecting a continuous flow of working fluid through the working fluid system while also providing power to accumulators 30 and 32 for pressurizing hydraulic fluid to drive a fluid motor 33 for generating mechanical energy.

It is desirable to have a liquid working fluid with a low compressibility and high expansion properties. A working fluid which has been found to be satisfactory is a fluorocarbon liquid designated as "Freon 12" and having a critical temperature of 234° F. at which it changes from a liquid state to a vapor or gaseous state. It is desirable to have the maximum or high temperature of the working fluid around 50° F. below the critical temperature, and the maximum temperature of the "Freon 12" working liquid in the present working fluid system is around 180° F. while the minimum temperature is around 80° F., providing a temperature differential of around 100° F. The pressure changes from a low pressure of around three hundred fifty (350) psi to around three thousand (3000) psi. A suitable liquid working fluid would probably have a high pressure at least around five times greater than the low pressure for satisfactory performance. It is believed that the maximum temperature of a liquid working fluid should be at least around 25° F. below the critical temperature of the working fluid.

As a specific but non-limiting example of a liquid working fluid comprising "Freon 12" in heat engine 10, the temperatures in degrees Fahrenheit and pressures in pounds per square inch (psi) are shown for each phase of the cycle at the areas indicated:

| Location | Cycle Start | First Quarter Phase | Second Quarter Phase | Third Quarter Phase |
|---|---|---|---|---|
| Line 34 (Low Pressure Inlet for Heat Exchanger 12) | 390 psi 177° F. | 390 psi 177° F. | 350 psi 177° F. | 390 psi 177° F. |
| Line 36 (Low Pressure Outlet for Heat Exchanger 12) | 365 psi 81° F. | 365 psi 81° F. | 350 psi 81° F. | 365 psi 81° F. |
| Line 37 (Low Pressure Outlet from Cooler 16) | 350 psi 80° F. | 350 psi 80° F. | 350 psi 80° F. | 350 psi 80° F. |
| Line 38 (High Pressure Inlet for Heat Exchanger 12) | 2590 psi 80° F. | 2990 psi 80° F. | 3000 psi 80° F. | 2990 psi 80° F. |
| Line 40 (High Pressure Outlet for Heat Exchanger 12) | 2565 psi 176° F. | 2965 psi 176° F. | 3000 psi 176° F. | 2965 psi 176° F. |
| Line 42 (High Pressure Outlet from Heater 42) | 2550 psi 180° F. | 2950 psi 180° F. | 3000 psi 180° F. | 2950 psi 180° F. |
| Line 50 (Lower end of Displacer Cylinder 20) | 2550 psi 180° F. | 2950 psi 180° F. | 2000 psi 180° F. | 400 psi 177° F. |
| Line 48 (Upper end of Displacer Cylinder 20) | 2600 psi 80° F. | 3000 psi 80° F. | 2000 psi 80° F. | 350 psi 80° F. |
| Line 44 (Lower end of Displacer Cylinder 18) | 400 psi 177° F. | 400 psi 177° F. | 2000 psi 177° F. | 2950 psi 180° F. |
| Line 43 (Upper end of Displacer Cylinder 18) | 350 psi 80° F. | 350 psi 80° F. | 2000 psi 80° F. | 3000 psi 80° F. |

From the above example, it is illustrated that low pressure working fluid enters heat exchanger 12 at a temperature of 177° F. and a pressure of 390 psi and leaves heat exchanger 12 at a temperature of 81° F. and a pressure of 365 psi. High pressure working fluid enters heat exchanger 12 at a temperature of 80° F. and a pressure of 2590 psi and leaves heat exchanger 12 at a temperature of 176° F. and a pressure of 2965 psi. When the high pressure working fluid leaves heater 14 it is at a temperature of 180° F. and a pressure of 2950 psi. Thus, a highly effective transfer of heat takes place between the low pressure working fluid and the high pressure working fluid within heat exchanger 12 with a relatively small decrease in pressure.

It is desirable that the liquid working fluid have a coefficient of thermal expansion of around 0.20, or 20%. Working fluids having a coefficient of thermal expansion of between 10% and 30% are believed to be satisfactory. Since the working fluid remains in a liquid state throughout the entire cycle of operation, the heat of vaporization of the working fluid has no effect on efficiency. The fluid compressibility of the working fluid has only a minimal effect on efficiency as the highest temperature reached by the working fluid is around 50° F. below its critical temperature.

Heat exchanger 12 as shown particularly in FIGS. 12–15 is comprised of a plurality of intermediate rectangular plates sandwiched tightly between two end header plates 76 and 78 which are of a relatively large thickness, such as one inch (1"), which is needed to withstand the relatively high pressure in the high pressure working fluid. The intermediate plates comprise repeating sets of four (4) plates, each set including a pair of spacer plates 80, a low pressure plate 82 sandwiched between a pair of spacer plates 80, and a high pressure plate 84 sandwiched between a pair of spacer plates 80. As many as around one hundred and twenty-five (125) sets of plates may be employed, each set including four (4) plates.

Figure 13:
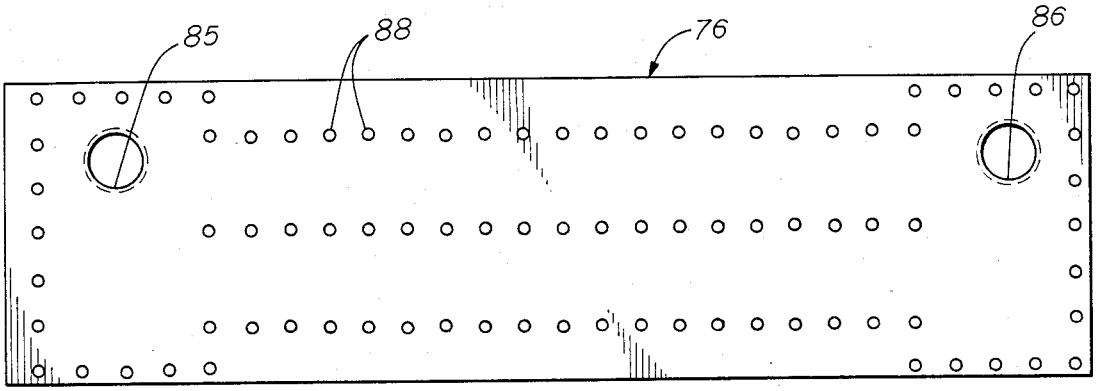
FIG. 13 is a plan view of an end plate for the heat exchanger.
Figure 14:
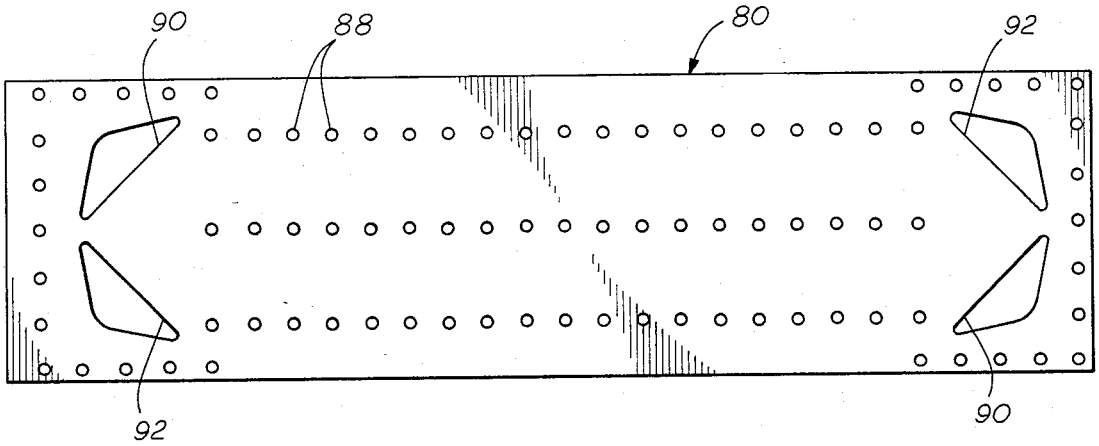
FIG. 14 is a plan view of a spacer plate for the heat exchanger.
Figure 15:
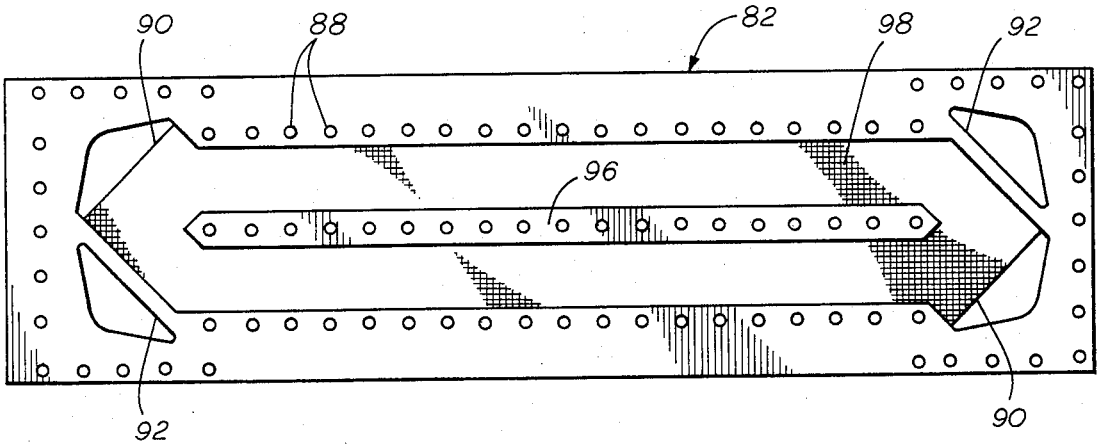
FIG. 15 is a plan view of an intermediate plate between the spacer plates and showing a flow path for the working fluid with a porous metallic material in the flow path.

End plate 76 as shown in FIG. 13 has a pair of inlet openings 85 and 86 for respective low pressure working fluid and high pressure working fluid. A plurality of openings 88 are provided to receive suitable bolted connections 89 as shown in FIG. 4 for securing the plates together. All of the intermediate plates have a pair of low pressure working fluid openings 90 and a pair of high pressure working fluid openings 92, with openings 90 being in fluid communication with inlet 85 and openings 92 being in fluid communication with inlet 86. Low pressure plate 82 shown in FIG. 15 has a cutout portion 94 in which openings 90 are located. Fitting within cutout portion 94 is a separate center strip 96 and a metallic mesh material 98 of a predetermined porosity positioned between the opposed openings 90. Mesh material 98 diffuses the flow of working fluid for maintaining a generally uniform temperature while also acting to reinforce low pressure plate 82 and minimize any bowing thereof resulting from high pressure plate 84. Plate 84 is similar to plate 82 except openings 92 are connected and the porous material is provided between openings 92 to provide the flow path for the high pressure working fluid. Plates 80, 82 and 84 are very thin to permit a highly efficient transfer of heat energy between the low pressure working fluid and the high pressure working fluid as indicated above. A thickness of around 0.016" has been found to function satisfactorily for plates 80, 82, and 84. Plates 80, 82 are preferably formed of a high thermal conductivity material, such as, for example, copper or aluminum.

As shown in FIGS. 1 and 2, heater 14 comprises a plurality of coils 98 each having a plurality of fins 100. Fins 100 may be heated from a suitable fluid, such as waste or exhaust air from air conditioners or the like, for example, or from a source of hot or warm water.

Cooling element or cooler 16 likewise comprises a plurality of tubular coils 102 having a plurality of fins 104 thereabout. Fins 104 may be suitably cooled by a fan or blower (not shown) conducting cool air along the surface of the fins for cooling of the working fluid.

Figure 17:
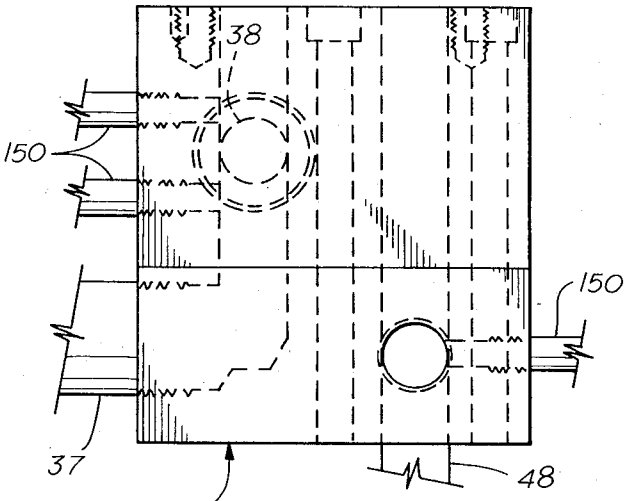
FIG. 17 is an elevation view looking generally along line 17—17 of FIG. 16.
Figure 16:
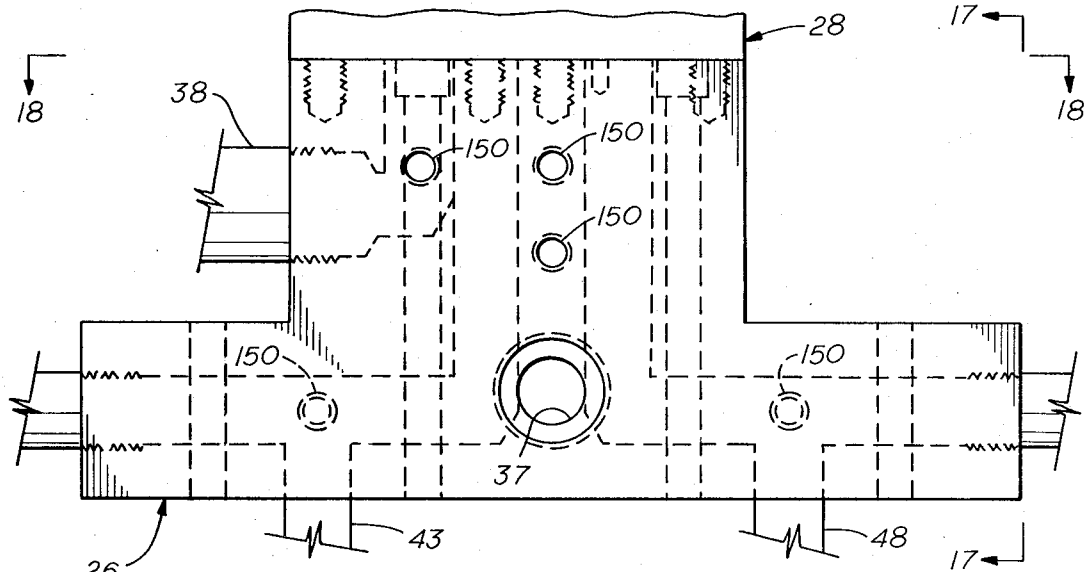
FIG. 16 is a plan of the manifold receiving the working fluid from the heat exchanger for transmitting to the displacer cylinders.
Figure 18:
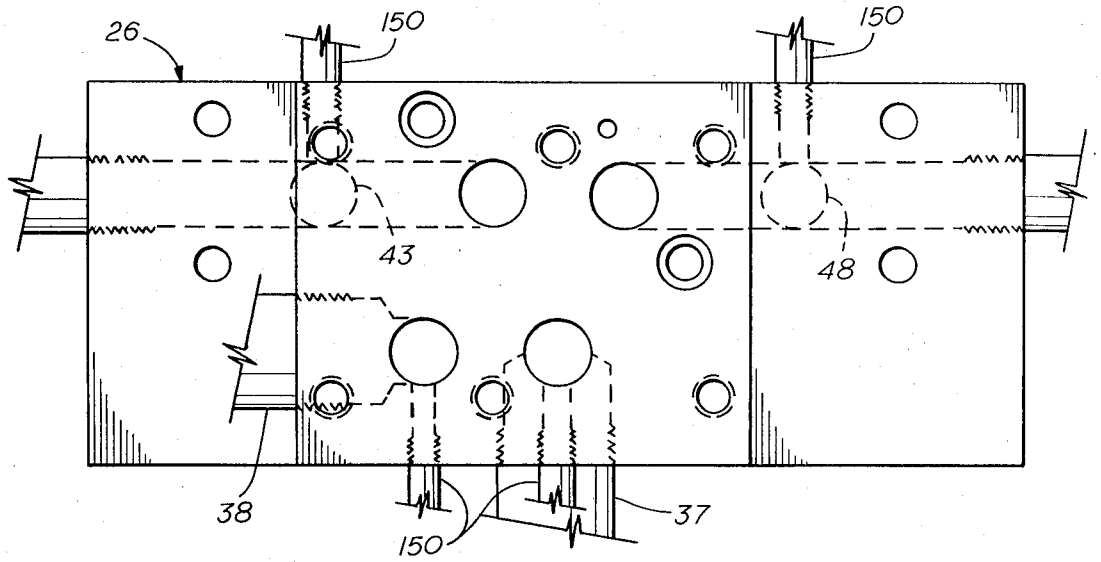
FIG. 18 is an elevation view looking generally along line 18—18 of FIG. 16.
Figure 19:
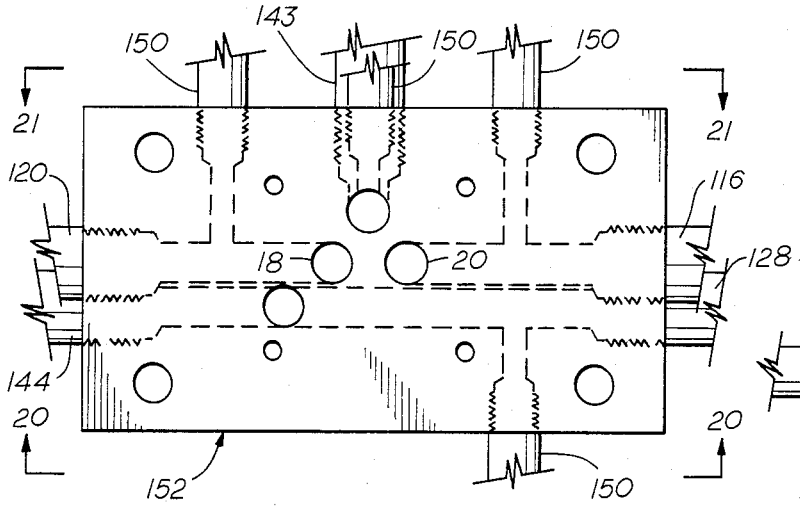
FIG. 19. is a plan view of the manifold for the separate hydraulic fluid system.
Figure 22:
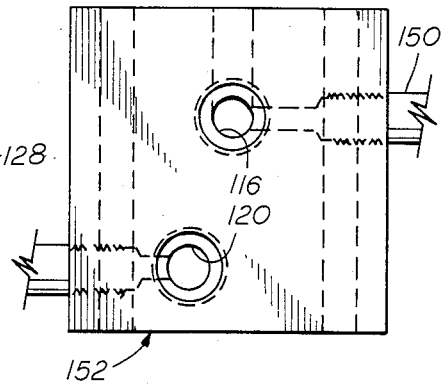
FIG. 22 is a view looking generally along line 22—22 of FIG. 20.
Figure 20:
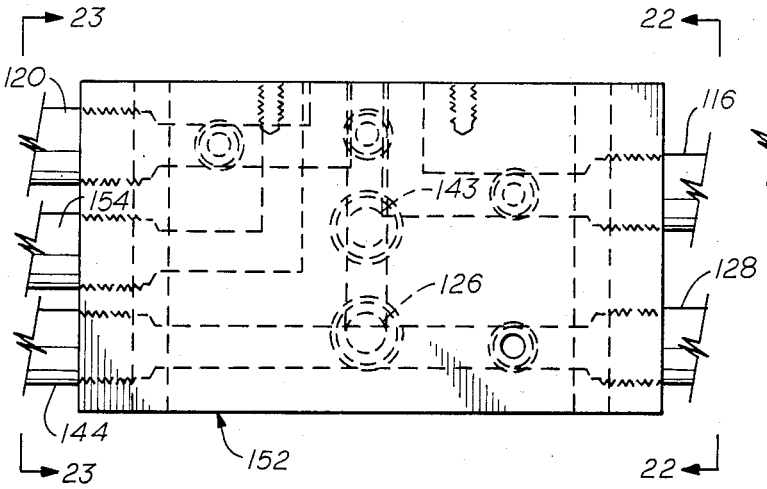
FIG. 20 is an elevation view looking generally along line 20—20 of FIG. 19.
Figure 23:
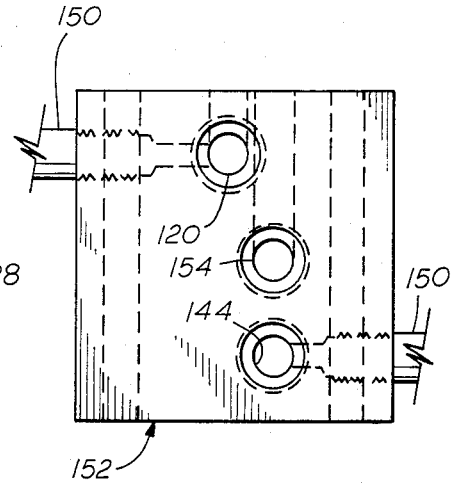
FIG. 23 is an elevational view looking generally along line 23—23 of FIG. 20.
Figure 21:
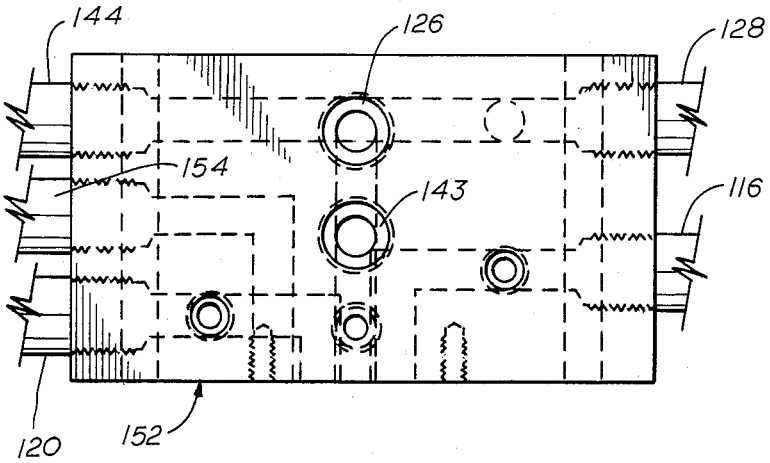
FIG. 21 is an elevation view looking generally along line 21—21 of FIG. 19.

Referring to FIGS. 16–18, and also to FIG. 4, manifold 26 for the working fluid system is illustrated showing low pressure line 37 from cooler 16, and high pressure line 38 to heat exchanger 12. Fluid line 43 for the working fluid extends between three-way valve 28 and displacer cylinder 18, and fluid line 48 extends between three-way valve 28 and displacer cylinder 20. Three-way valve 28 is associated with manifold 26 for alternating the flow of high pressure working fluid and low pressure working fluid between displacer cylinders 18 and 20.

Figure 3:
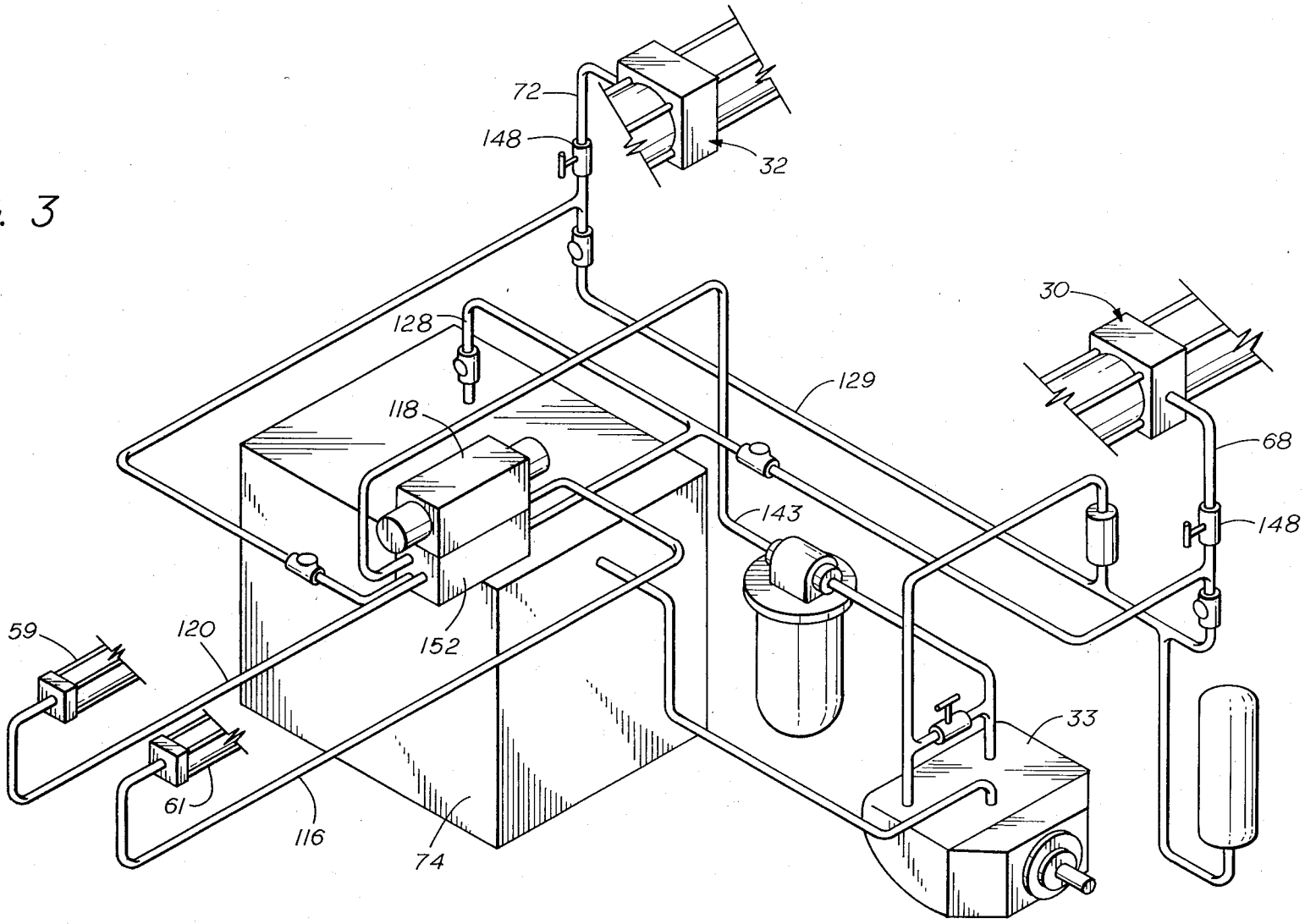
FIG. 3 is a perspective, partly schematic, illustrating the hydraulic fluid pressure system of this invention.
Figure 11:
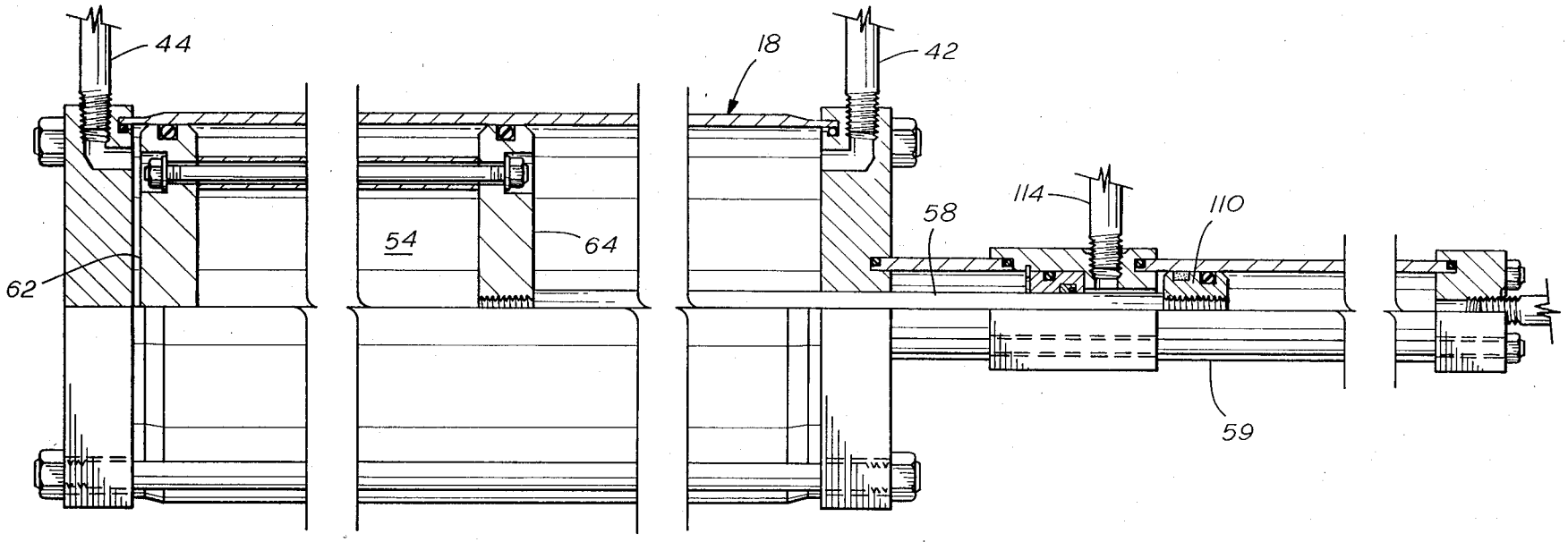
FIG. 11 is a longitudinal section view, partly in elevation, showing a hydraulic fluid cylinder for driving an associated displacer cylinder.
Figure 12:
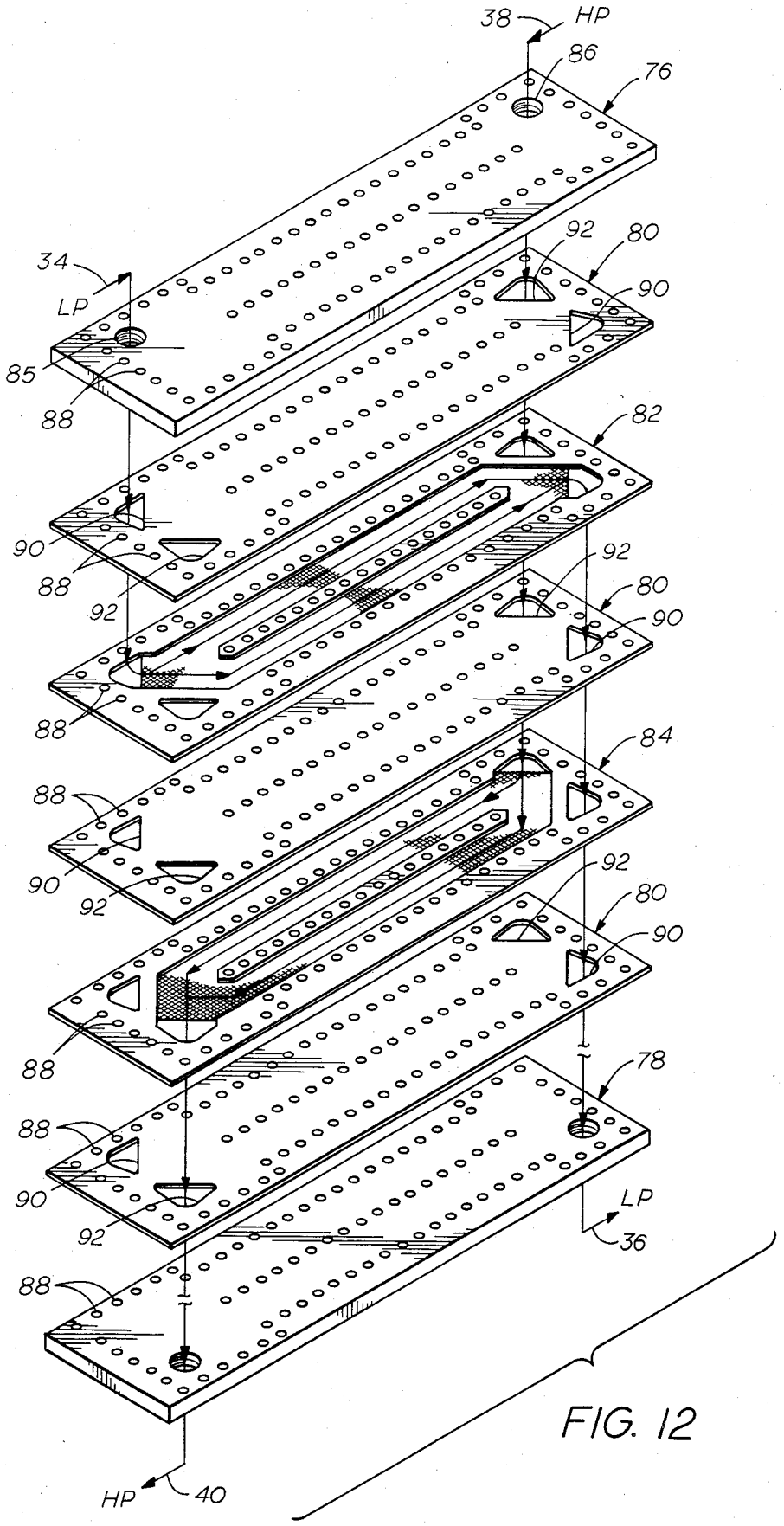
FIG. 12 is an exploded view of a portion of the heat exchanger showing a set of rectangular plates providing the separate flow paths for high pressure working fluid and low pressure working fluid.

A separate hydraulic fluid system is provided for heat engine 10. Referring particularly to FIGS. 3 and 4, small diameter hydraulic fluid cylinders 59 and 61 are illustrated for respective displacer cylinders 18 and 20. As shown particularly in FIG. 11, single acting hydraulic fluid cylinder 59 has a piston 110 connected to piston rod 58 which is connected at its opposite end to piston 54 of displacer cylinder 18. Cylinder 61 is similar to cylinder 59. Power cylinders 59 and 61 are provided to supplement the power obtained from the power stroke of displacer cylinders 18 and 20 resulting from the high pressure working fluid. Hydraulic line 114 connects cylinders 59 and 61 to provide a free flow of hydraulic fluid therebetween. Hydraulic fluid line 116 extends from cylinder 61 to a three-way valve generally indicated at 118. Hydraulic fluid line 120 extends from cylinder 59 to a three-way valve 118. Three-way valve 118 may be solenoid operated as well known and is actuated to reverse the flow of hydraulic fluid to power cylinders 59 and 61 upon the actuation of three-way valves 24 and 28 to reverse the flow of working fluid to displacer cylinders 18 and 20. Hydraulic fluid reservoir shown at 74 has a pump 122 therein driven by motor 124 for startup purposes only. Hydraulic fluid is supplied through line 126 to cylinders 59 and 61 and returned by return line 128 to the sump in hydraulic reservoir 74.

Figure 9:
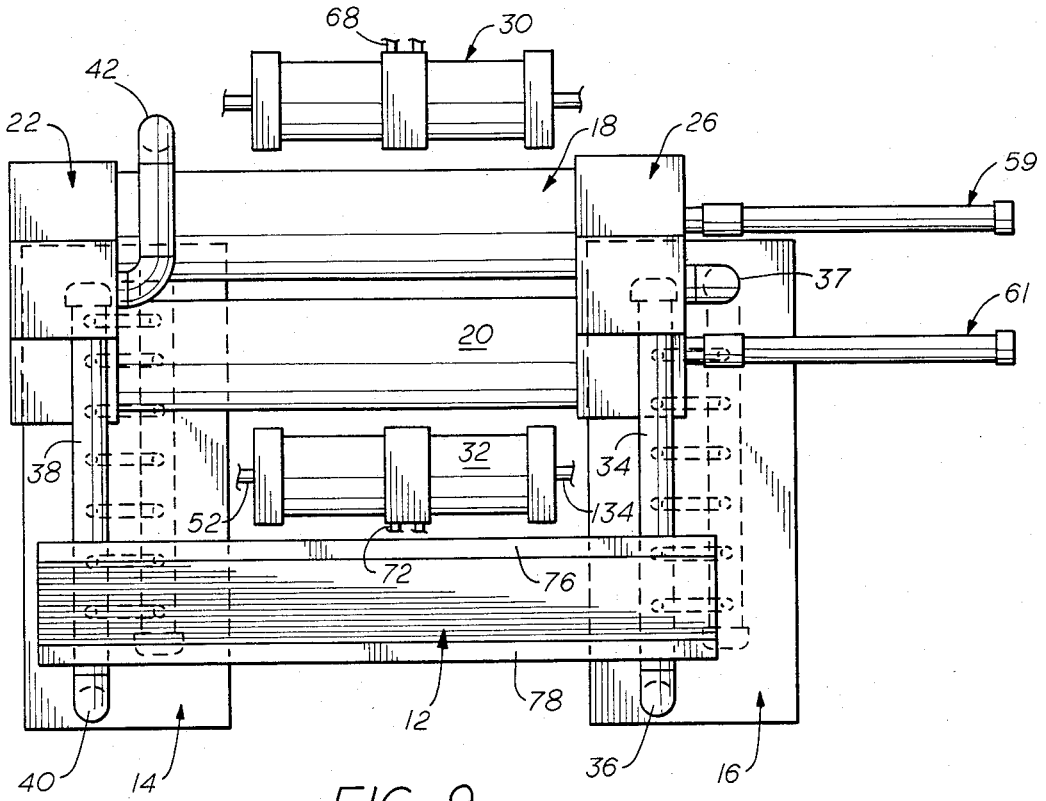
FIG. 9 is a plan view of the elements in the working fluid system.
Figure 10:
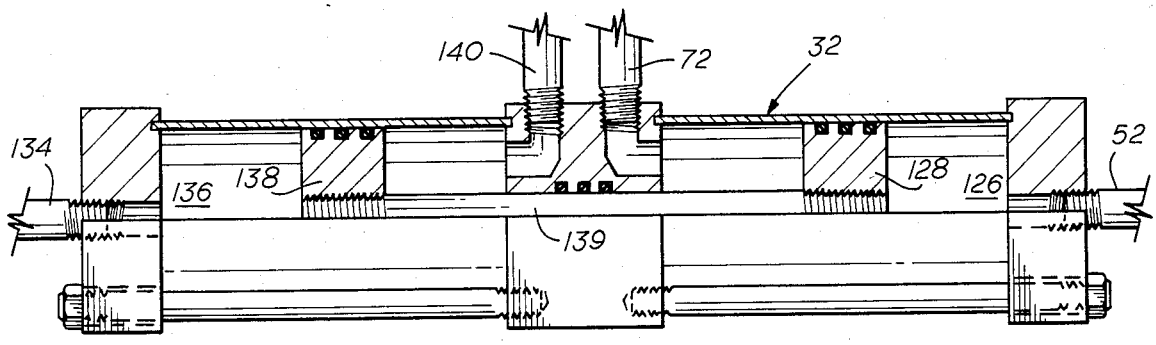
FIG. 10 is a longitudinal section view, partly in elevation, showing an accumulator in which working fluid is supplied adjacent one end thereof and hydraulic fluid is supplied adjacent the other end thereof for transmitting fluid pressure from the working fluid to the hydraulic fluid.

As indicated above, hydraulic motor 33 is operated by hydraulic fluid alternately from accumulators 30 and 32. Referring particularly to FIGS. 9 and 10, accumulator 32 as illustrated shows high pressure working fluid supplied through line 52 into working fluid chamber 126 against piston 128. Hydraulic fluid chamber 130 on the opposed side of piston 128 has a hydraulic fluid line 72 in fluid communication and extends from accumulator 32 to motor 33 for driving motor 33. A pressurized source of gas, such as nitrogen, is supplied from a bottle or tank 132 through line 134 into a gas chamber 136 which acts against piston 138 connected by piston rod 139 to piston 128. A vent to atmosphere is provided at 140. Pressurized gas chamber 136 acts as a spring for returning piston 128 to its original position after a power stroke resulting from high pressure working fluid being provided in chamber 126. Accumulators 30 and 32 are supplied alternately with high pressure working fluid from respective displacer cylinders 18 and 20, thereby to drive fluid motor 33 continuously through lines 68 and 72. Accumulators 30 and 32 thus act as pumps to pressurize the hydraulic fluid for supply to motor 33. Motor 33 is connected to a gear reduction unit 141 which may in turn be connected to a flywheel for driving a generator 142 to produce electrical energy. Motor 33 may also be utilized to supply hydraulic fluid through line 143 to cylinders 59 and 61 and through line 144 to accumulators 30 and 32 for their return stroke.

Suitable check valves 146 are provided at desired locations as indicated and suitable on-off valves 148 are provided for isolating any desired part of the hydraulic fluid system. Suitable gauges 150 may be provided at selected portions of both the hydraulic fluid system and the working fluid system for taking desired pressure and temperature readings. FIG. 3 also shows in diagrammatic fashion the hydraulic fluid system as described for FIG. 4.

Referring now to FIGS. 19–23, and also to FIG. 4, a manifold for the hydraulic fluid injector is illustrated generally at 152. Three-way valve 118 is associated with manifold 152 for the hydraulic fluid. Fluid lines 116 and 120 to hydraulic cylinders 59 and 61 are shown. Return line 128 to reservoir 74 is also illustrated.

Figure 24:
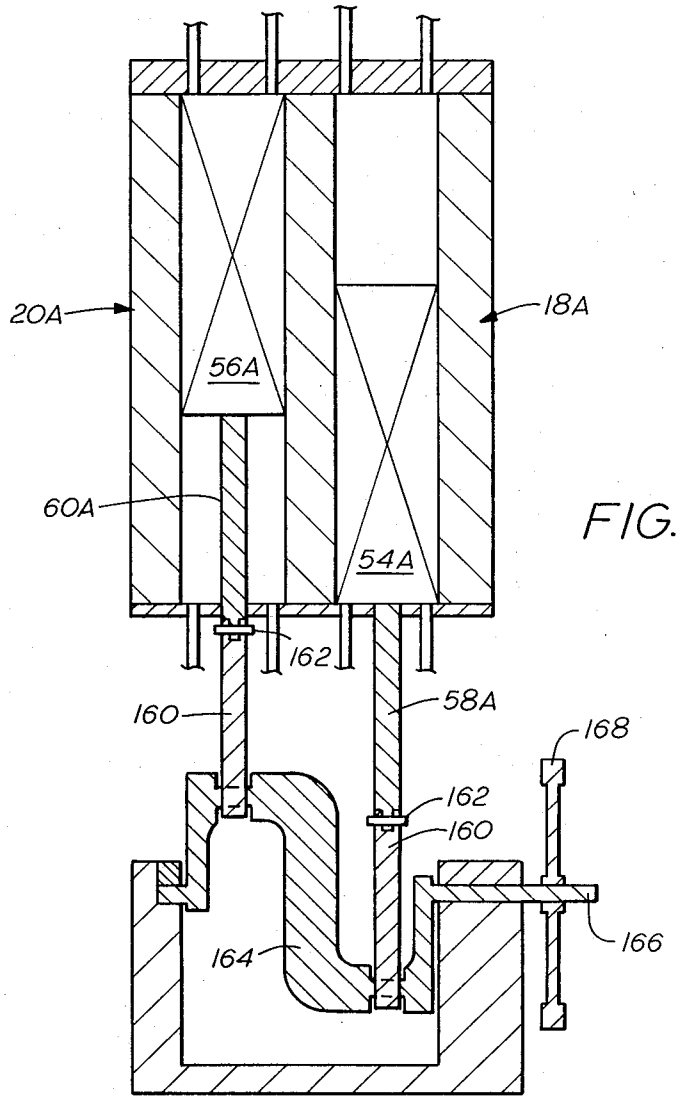
FIG. 24 is a section, partly schematic, of another embodiment of the invention in which the displacer cylinders are utilized to drive a crankshaft for the generation of mechanical energy.

Another embodiment is shown in FIG. 24 to provide means for producing mechanical energy. As shown in FIG. 24, displacer cylinders 18A and 20A have respective pistons 54A and 56A mounted therein with piston rods 58A and 60A extending from pistons 54A and 56A. Connecting rods 160 are connected by pinions 162 to piston rods 58A and 60A at one end, and connected at their other end to a crankshaft shown at 164. Crankshaft 164 upon reciprocation of displacer cylinders 18A and 20A from high pressure working fluid as in the embodiment shown in FIGS. 1–23 is rotated to rotate a drive output shaft 166 having a suitable flywheel 168 connected thereto. Drive output shaft 166 may be connected to a generator, turbine, or the like to provide a mechanical power output. It is apparent that other types of mechanical power outputs may be provided in association with the displacer cylinders 18A and 20A operated by the liquid working fluid system as shown in FIGS. 1–23.

Figure 25:
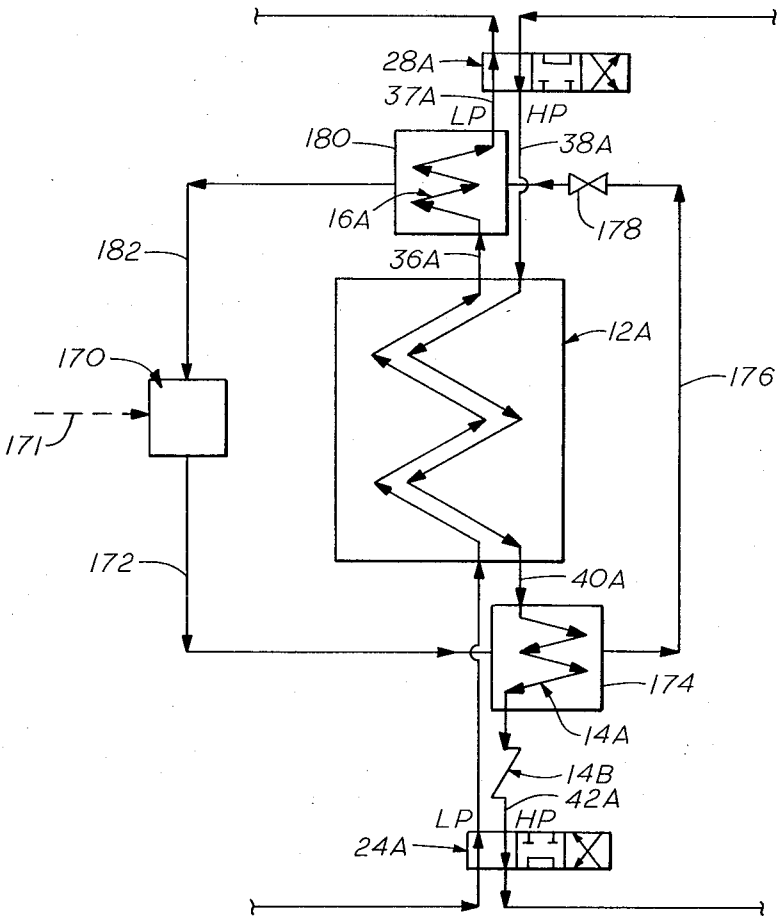
FIG. 25 is a schematic of a further embodiment of our invention in which a heat pump is utilized to transfer heat to heating means for the heat exchanger.

Referring now to FIG. 25, a separate embodiment illustrating a heat pump incorporated with the system of FIGS. 1–23 as shown. Heat exchanger 12A between three-way valves 24A and 28A operates in the same manner as in the embodiment of FIGS. 1–23 with low pressure working fluid and high pressure working fluid flowing continuously in the same direction between valves 24A and 28A throughout the entire operating cycle. High pressure working fluid line 38A from three-way valve 28A leads to heat exchanger 12A and exits heat exchanger 12A from line 40A to a combined heater element 14A and condenser 174. The high pressure working fluid then flows to a second heater element 14B, and then through line 42A to three-way valve 24A for alternate flow to the displacer cylinders (not shown). Low pressure working fluid from three-way valve 24A flows through line 34A to heat exchanger 12A. The low pressure working fluid leaves heat exchanger 12A through line 36A and flows to a combined evaporator 180 and cooler element 16A. Low pressure fluid leaving evaporator 180 and cooler element 16A through line 37A flows to three-way valve 28A for alternate flow to displacer cylinders (not shown).

The heat pump illustrated comprises a refrigeration system utilizing a refrigerant in a refrigeration cycle. A compressor 170 for the refrigerant is driven from a power output 171 from hydraulic motor 33. The flow of refrigerant from compressor 170 is through line 172 to condenser 174 associated with heater 14A. Then, the refrigerant after being condensed to a liquid state flows through line 176 to expansion valve 178 for a drop in temperature, and then to evaporator 180 associated with cooler 16A. Next, the refrigerant flows to compressor 170 through line 182 for another refrigeration cycle. It is noted that the entire apparatus is covered with a suitable insulation, such as a polyurethane foam material or suitable insulation panels, except for the coils for heater element 14A associated with condenser 174 which are exposed to ambient temperature.

By utilizing a heat pump as shown in FIG. 25, the temperature of heater 14A and cooler 16A can be decreased while still maintaining the required temperature differential across the entire system. Two heater elements, one being heater element 14A associated with condenser 174 and the other being heater element 14B, and cooler element 16A are necessary, however, to provide the desired temperature differential across the entire system. Ambient temperature may be used for heater element 14A associated with condenser 174 since the heat pump transfers heat energy from cooler 16A to heater 14A by utilizing only a relatively small amount of the mechanical energy generated, thereby minimizing the need for cooler 16A to operate above ambient temperature. The heat pump in transferring heat energy from cooler 16A to heater 14A effects a lowering of the required temperature in heater 14A.

Figure 26:
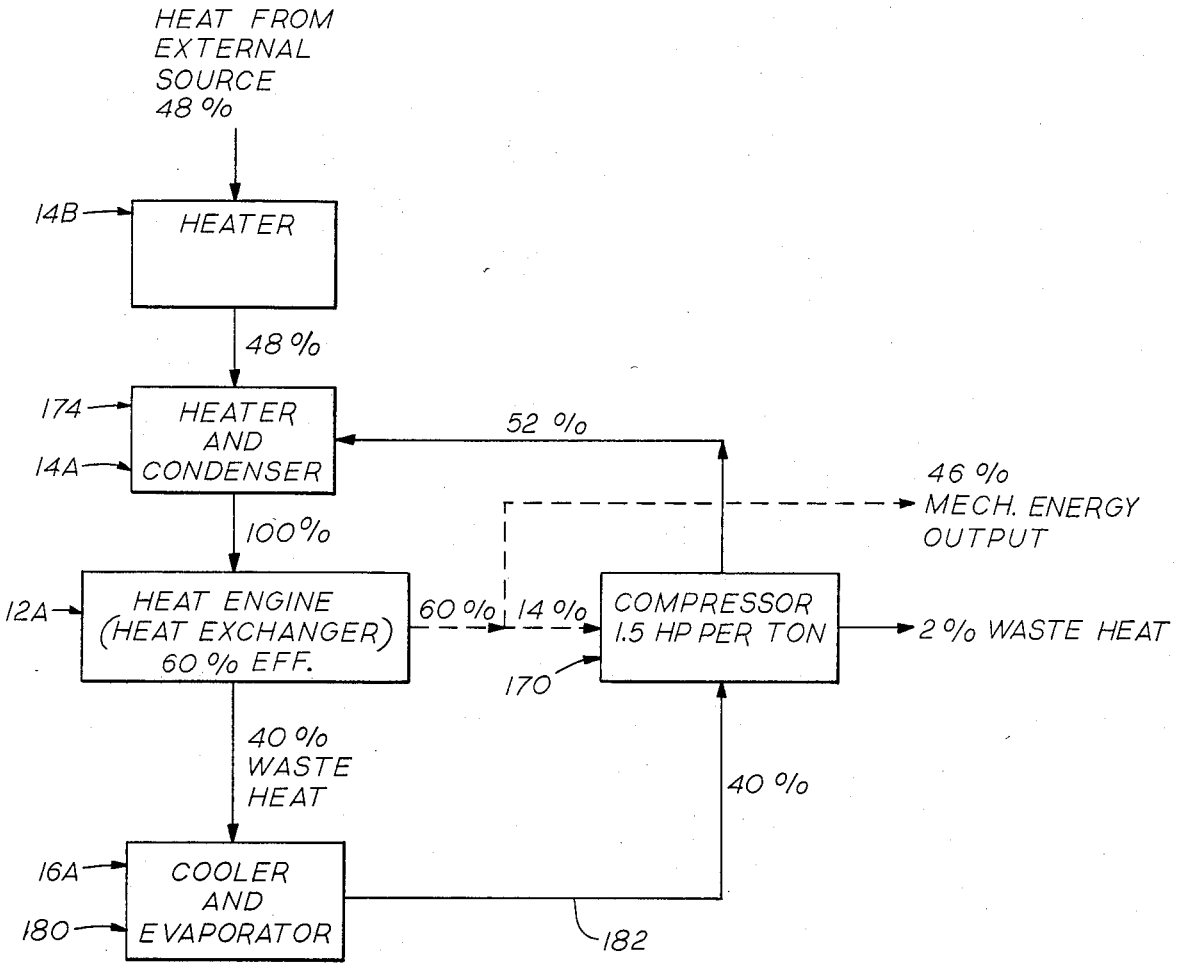
FIG. 26 is an energy flow diagram of the embodiment shown in FIG. 25.

Referring to FIG. 26, an energy flow diagram is shown for the heat pump arrangement shown in FIG. 25 illustrating the energy inputs and outputs from the heat engine. The heat energy is shown in solid lines while the mechanical energy is shown in broken lines. As shown, utilizing a heat engine of an efficiency of 60%, 48% of heat from an external source communicated to the heat engine including heat exchanger 12A results in a mechanical energy output of 46%, while 14% of such output is utilized for driving compressor 170. Thus, the highly efficient conversion of thermal energy to mechanical energy is provided by utilizing the heat pump arrangement shown in FIGS. 25 and 26. In regard to compressor 170, it is noted that one (1) BTU is required to transfer three (3) BTUs of refrigeration which correlates to 1.5 HP per ton of refrigeration.

The present invention is effective to provide a heat engine having a highly efficient heat exchanger as the working fluid remains in a liquid state throughout the entire operating cycle, and the compressibility of the working fluid does not have any appreciable effect on efficiency.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. In a heat engine having a liquid working fluid which remains in a liquid state throughout a complete cycle of the engine;

a heat exchanger having a low pressure liquid inlet and a low pressure liquid outlet for low pressure working fluid, a high pressure liquid inlet and a high pressure liquid outlet for high pressure working fluid, and separate paths therein for said low pressure working fluid and said high pressure working fluid;

a cooling element adjacent said heat exchanger and in fluid communication with said low pressure liquid outlet;

a heating element adjacent said heat exchanger and in fluid communication with said high pressure liquid outlet;

a pair of double acting cylinders arranged in opposed cycling relation to each other, each cylinder having a piston and a port for the working fluid adjacent each end of the cylinder;

and valve means between said pair of cylinders and said beating and cooling elements for controlling the flow of low pressure working fluid and high pressure working fluid alternately to said cylinders, said valve means operatively connected to said cylinder ports and movable between positions for reversing the flow of low pressure and high pressure working fluids to said cylinders so that low pressure and high pressure working fluids are alternately supplied to said cylinders during each complete cycle of the engine in a continuous operation.

2. In a heat engine as set forth in claim 1 wherein said heat exchanger comprises a plurality of generally rectangular heat transfer plates arranged in abutting face-to-face contact and having separate adjacent low pressure and high pressure working fluid paths therethrough with the low pressure working fluid flowing in a direction opposite that of the high pressure working fluid.

3. In a heat engine as set forth in claim 2 wherein each of said adjacent paths is directed in a generally lateral direction along the length of the heat exchanger to effect a heat transfer from the low pressure working fluid to the high pressure working fluid.

4. In a heat engine as set forth in claim 1 wherein said heat exchanger comprises a plurality of generally rectangular parallel intermediate plates tightly secured between a pair of opposed end plates, said plurality of intermediate plates including alternate spacer plates and thin intervening flow path plates, each flow path plate having a flow path extending along its length to direct the working fluid.

5. In a heat engine as set forth in claim 4 wherein said intervening flow path plates have a porous metallic mesh material in the flow path thereof to diffuse the working fluid flowing along the path to equalize the temperature of said working fluid flowing through the heat exchanger and to reinforce said intervening plates.

6. In a regenerative cycle heat engine having a liquid working fluid which remains in a liquid state throughout a complete cycle of the engine;

a heat exchanger having a low pressure liquid inlet and a low pressure liquid outlet for low pressure working fluid, a high pressure liquid inlet and a high pressure liquid outlet for high pressure working fluid, and separate paths therein for said low pressure working fluid and said high pressure working fluid;

a cooling element adjacent said heat exchanger and in fluid communication with said low pressure liquid outlet;

a heating element adjacent said heat exchanger and in fluid communication with said high pressure liquid outlet;

a pair of double acting cylinders arranged in opposed cycling relation to each other, each cylinder having a piston and a port for the working fluid adjacent each end of the cylinder; and a first valve means positioned adjacent the cooling element to receive low pressure working fluid from the cooling element and operatively connected to said pair of cylinders to control the flow of low pressure working fluid to the cylinders; and a second valve means positioned adjacent the heating element to receive the high pressure working fluid from the heating element and operatively connected to said pair of cylinders to control the flow of high pressure working fluid to said cylinders;

said second valve means being operatively connected to selected ports adjacent the ends of said pistons and selectively movable between positions for reversing the flow of high pressure working fluid to said selected ports so that high pressure working fluid is alternately supplied to said cylinders during each complete cycle of the engine in a continuous operation.

7. In a heat engine having a liquid working fluid which remains in a liquid state throughout a complete cycle of the engine;

a heat exchanger having a low pressure liquid inlet and a low pressure liquid outlet for low pressure working fluid, a high pressure liquid inlet and a high pressure liquid outlet for high pressure working fluid, and separate paths therein for said low pressure working fluid and said high pressure working fluid;

a cooling element adjacent said heat exchanger and in fluid communication with said low pressure liquid outlet;

a heating element adjacent said heat exchanger and in fluid communication with said high pressure liquid outlet;

a pair of double acting cylinders arranged in opposed cycling relation to each other, each cylinder having a piston and a port for the working fluid adjacent each end of the cylinder;

valve means between said pair of cylinders and said heating and cooling elements for controlling the flow of low pressure working fluid and high pressure working fluid alternately to said cylinders, said valve means operatively connected to said cylinder ports and movable between positions for reversing the flow of high pressure and low pressure working fluids to said cylinders so that high pressure and low pressure working fluids are alternately supplied to said cylinders during each complete cycle of the engine in a continuous operation;

a piston rod connected to the piston of each cylinder; and separate means for driving the piston rods alternately in a power stroke during each cycle of the engine.

8. In a regenerative cycle heat engine having a liquid working fluid which remains in a liquid state throughout a complete cycle of the engine;

a heat exchanger having a low pressure liquid inlet and a low pressure liquid outlet for low pressure working fluid, a high pressure liquid inlet and a high pressure liquid outlet for high pressure working fluid, and separate paths therein for said low pressure working fluid and said high pressure working fluid;

a cooling element adjacent said heat exchanger and in fluid communication with said low pressure liquid outlet;

a heating element adjacent said heat exchanger and in fluid communication with said high pressure liquid outlet;

a pair of double acting cylinders arranged in opposed cycling relation to each other, each cylinder having a piston and a port for the working fluid adjacent each end of the cylinder;

valve means between said pair of cylinders and said heating and cooling elements for controlling the flow of low pressure working fluid and high pressure working fluid alternately to said cylinders, said valve means operatively connected to said cylinders ports and movable between positions for reversing the flow of low pressure and high pressure working fluids to said cylinders so that low pressure and high pressure working fluids are alternately supplied to said cylinders during each complete cycle of the engine in a continuous operation;

a realtively small diameter power cylinder for each working fluid displacer cylinder and having a piston therein, a piston rod connecting the pistons of each small diameter power cylinder and its associated large diameter displacer cylinder; and fluid pressure means for said power cylinders controlling the movement of the pistons therein thereby to control the movement of said displacement cylinders.

9. In a heat engine as set forth in claim 8 wherein said power cylinders are hydraulic fluid power cylinders, and said fluid pressure means including three-way valves for alternately reversing the flow of hydraulic fluid to said power cylinders for supplementing the power stroke of said displacer cylinders.

10. In a heat engine having a liquid working fluid which remains in a liquid state throughout a complete cycle of the engine;

a heat exchanger having a low pressure liquid inlet and a low pressure liquid outlet for low pressure working fluid, a high pressure liquid inlet and a high pressure liquid outlet for high pressure working fluid, and separate paths therein for said low pressure working fluid and said high pressure working fluid;

a cooling element adjacent said heat exchanger and in fluid communication with said low pressure liquid outlet;

a heating element adjacent said heat exchanger and in fluid communication with said high pressure liquid outlet;

a pair of double acting displacer cylinders for displacing working fluid and arranged in opposed cycling relation to each other, each cylinder having a piston and a port for the working fluid adjacent each end of the cylinder;

means between said pair of cylinders and said heating and colling elements for controlling the flow of low pressure working fluid and high pressure working fluid to and from displacer cylinders in a continuous cycle; and a power cylinder for each displacer cylinder, each power cylinder being connected to the cylinder of the associated displacer cylinder to move the piston back and forth in a reciprocal action for displacing the working fluid.

11. In a heat engine having a liquid working fluid which remains in a liquid state throughout a complete cycle of the engine;

a heat exchanger having a low pressure liquid inlet and a low pressure liquid outlet for low pressure working fluid, a high pressure liquid inlet and a high pressure liquid outlet for high pressure working fluid, and separate paths therein for said low pressure working fluid and said high pressure working fluid;

a cooling element adjacent said heat exchanger and in fluid communication with said low pressure liquid outlet;

a heating element adjacent said heat exchanger and in fluid communication with said high pressure liquid outlet;

a pair of displacer cylinders arranged in opposed cycling relation to each other for the alternate discharge of working fluid, each cylinder having a piston and a port for the working fluid adjacent an end of the cylinder;

valve means between said pair of cylinders and said heating and cooling elements for controlling the flow of low pressure working fluid and high pressure working fluid, said valve means operatively connected to said cylinder ports and movable between positions for reversing the flow of high pressure working fluid to said cylinders so that high pressure working fluid is alternately supplied to said cylinders during each complete cycle of the engine in a continuous operation; and a power cylinder for each displacer cylinder, each power cylinder having a piston connected to the piston of the associated displacer piston for driving the displacer piston in a power stroke for the discharge of working fluid therefrom.

12. In a heat engine as set forth in claim 11 wherein said cooling element comprises a plurality of cooling coils having fins thereabout and receiving the low pressure working fluid from the heat exchanger, and said heating element comprises a plurality of heating coils having fins thereabout and receiving the high pressure working fluid from the heat exchanger.

13. In a heat engine as set forth in claim 12 wherein high pressure working fluid from said heater element is continuously supplied in an alternating manner to said pair of displacer cylinders;

and low pressure working fluid from said cooling element is continuously supplied in an alternating manner to said pair of displacer cylinders.

14. In a heat engine as set forth in claim 11 wherein each of said power cylinders has a piston therein, and a piston rod extends between and is secured to the pistons of each associated pair of power and displacer cylinders to provide a driving connection therebetween.

15. In a heat engine as set forth in claim 14 wherein hydraulic fluid pressure means are operatively connected to said power cylinders for fluid operation thereof;

fluid pressure transfer means are provided between said high pressure working fluid and said hydraulic fluid pressure means to transmit high fluid pressure from the working fluid to said hydraulic fluid pressure means;

and a fluid pressure operated means generating a mechanical output is operatively connected to said fluid pressure transfer means and is driven thereby upon the transmitting of a high fluid pressure from said high pressure working fluid.

16. In a heat engine as set forth in claim 15 wherein said fluid pressure transfer means compresses an accumulator having a piston therein separating the high fluid pressure working fluid from the hydraulic fluid pressure means and transmits fluid pressure to the hydraulic fluid pressure means from the working fluid.

17. In a heat engine as set forth in claim 15 wherein said fluid pressure transfer means comprises an accumulator for each of the displacer cylinders, each accumulator having a piston therein separating working fluid from the hydraulic fluid pressure means;

the heat exchanger supplying high pressure working fluid alternately to said accumulators for continuously transmitting a high fluid pressure to said hydraulic fluid pressure means for said fluid pressure operated means generating a mechanical output.

18. A heat engine having a liquid working fluid which remains in a substantially liquid state throughout a complete cycle, said heat engine comprising in combination:

a heat exchanger having separate adjacent flow paths therethrough for low pressure working fluid and high pressure working fluid to effect a transfer of heat from the low pressure working fluid to the high pressure working fluid;

a cooler receiving low pressure working fluid from said heat exchanger;

a heater receiving high pressure working fluid from said heat exchanger;

a pair of double-acting displacer cylinders arranged in opposed cycling relation to each other, said cylinders alternately receiving high pressure working fluid from said heater and low pressure working fluid from said cooler;

means between the heat exchanger and said cylinders controlling the alternate supply of high pressure working fluid to said cylinders to provide a continuous output of high temperature high pressure working fluid to said displacer cylinders; and means operatively responsive to the reciprocation of said cylinders and continuous output of high temperature high pressure working fluid from said heat, exchanger for generating a mechanical power output.

19. A heat engine as set forth in claim 18 wherein said means operatively responsive to the continuous output of high pressure working fluid comprises hydraulic fluid pressure means including a hydraulic fluid motor driven from pressurized hydraulic fluid to generate a mechanical power output.

20. A heat engine as set forth in claim 18 wherein said means operatively responsive to the continuous output of high pressure working fluid comprises a crankshaft operatively connected to said displacer cylinders and being rotated therefrom to generate a mechanical power output.

21. A heat engine as set forth in claim 18 wherein said means to drive the displacer cylinder comprises a hydraulic fluid pressure power cylinder for each displacer cylinder, each associated pair of power and displacer cylinders having pistons connected in a drive relation to each other by a connecting piston rod secured to the pistons.

22. A heat engine as set forth in claim 19 wherein a fluid accumulator is provided between said heater and said hydraulic fluid motor, said accumulator having a piston therein exposed on one face thereof to high temperature high pressure working fluid from said heater and exposed on the other face thereof to hydraulic fluid for driving said hydraulic fluid motor whereby upon the supply of high pressure working fluid said heater the associated accumulator transmits fluid pressure to the hydraulic fluid to effect driving of said hydraulic fluid motor.

23. A heat engine as set forth in claim 17 wherein heat pump means are provided between said heater and said cooler to transfer heat energy from said cooler to said heater.

24. A heat engine as set forth in claim 23 wherein said heat pump means comprises a compressor driven from said means for generating a mechanical power output.

25. A heat engine as set forth in claim 23 wherein said heat pump means utilizes a refrigeration cycle having a refrigerant and includes a compressor for the refrigerant driven from said means for generating a mechanical power output, an evaporator for said refrigerant associated with said cooler, and a condenser for said refrigerant associated with said heater and transferring heat energy from said cooler to said heater.

26. A heat engine having a liquid wqrking fluid which remains in a substantially liquid state throughout a complete cycle, said heat engine comprising in combination:

a heat exchanger having separate adjacent flow paths therethrough for low pressure working fluid and high pressure working fluid to effect a transfer of heat from the low pressure working fluid to the high pressure working fluid;

a cooler receiving low pressure working fluid from said heat exchanger;

a heater receiving high pressure working fluid from said heat exchanger;

a pair of double-acting displacer cylinders arranged in opposed cycling relation to each other, said cylinders alternately receiving high pressure working fluid from said heater and low pressure working fluid from said cooler;

means between the heat exchanger and said cylinders controlling the alternate supply of high pressure working fluid to said cylinders to provide a continuous output of high temperature high pressure working fluid to said displacer cylinders;

means operatively responsive to the reciprocation of said cylinders and continuous output of high temperature high pressure working fluid from said heat exchanger for generating a mechanical power output; and heat pump means between said heater and said cooler to effect a transfer of heat energy from said cooler to said heater, said heat pump means utilizing a refrigeration cycle and a refrigerant in said cycle.

27. A heat engine as set forth in claim 26 wherein said heat pump means includes a compressor for the refrigerant, an evaporator for said refrigerant associated with said cooler, and a condenser for said refrigerant associated with said heater and transferring heat energy from said cooler to said heater.

28. A heat engine as set forth in claim 27 wherein said heater includes two heater elements arranged in series for the flow of working fluid therethrough, one of said heater elements associated with said condenser and the other of said heater elements located downstream from said first heater element to receive working fluid therefrom.

29. A heat engine as set forth in claim 28 wherein insulation is provided over the entire heat engine except said first heater element associated with said condenser, said first heater element including a plurality of coils exposed to ambient temperature.

30. A method of utilizing a liquid working liquid in a regenerative cycle heat engine which remains in a substantially liquid state throughout a complete cycle of the engine, said method comprising the steps of:

providing low pressure working fluid and high pressure working fluid to a pair of displacer cylinders having opposed operating cycles with one cylinder receiving and discharging low pressure working fluid and the other cylinder simultaneously receiving and discharging high pressure working fluid thereby to provide a continuous discharge of high pressure working fluid and low pressure from the pair of cylinders in alternating relation;

introducing the discharged low pressure working fluid and discharged high pressure working fluid into a heat exchanger in which the high pressure working fluid increases in temperature and the low pressure working fluid decreases in temperature to effect a transfer of heat from the low pressure working fluid to the high pressure working fluid;

introducing high pressure working fluid discharged from the heat exchanger into a heater;

introducing low pressure working fluid discharged from the heat exchanger into a cooler;

introducing the low pressure low temperature working fluid discharged from the cooler into one of the displacer cylinders and introducing the high pressure high temperature working fluid discharged from the heater into the other displacer cylinder; and alternating simultaneously the introduction of low pressure working fluid and high pressure working fluid to said pair of cylinders thereby to provide a continuous discharge of low pressure and high pressure working fluids to the pair of displacer cylinders.

31. The method as set forth in claim 30 further comprising the step of utilizing the high temperature high pressure working fluid discharged from the heater to drive means to provide mechanical energy.

32. The method as set forth in claim 30 further comprising the steps of:

providing a source of hydraulic fluid to a hydraulic motor; and causing the discharged high pressure working fluid from the heater to transmit a high pressure to the hydraulic fluid for driving the hydraulic motor and thereby providing mechanical energy.

33. The method as set forth in claim 30 further comprising the step of:

driving the displacer cylinders from separate hydraulic fluid pressure means operatively connected to the displacer cylinders.

34. A method of providing mechanical energy from thermal energy in a continuously cycling heat engine utilizing a liquid working fluid which remains in a substantially liquid state throughout a complete cycle of the heat engine; said method comprising the steps of:

providing a heat exchanger to receive high temperature low pressure working fluid and low temperature high pressure working fluid for flow through the heat exchanger in separate adjacent paths for transferring heat from said low pressure working fluid to said high pressure working fluid, and subsequent discharge of the low pressure working fluid at a low temperature and discharge of the high pressure working fluid at a high temperature;

supplying the discharged low pressure working fluid and discharged high pressure working fluid in alternating relation to a pair of displacer cylinders having opposed cycles, one cylinder alternately receiving and displacing low pressure working fluid and the other cylinder simultaneously and alternately receiving and displacing high pressure working fluid thereby to provide a continuous displacement of high pressure working fluid and low pressure working fluid from the pair of cylinders in alternating relation; and utilizing the high temperature high pressure working fluid to drive means for providing mechanical energy.

35. The method as set forth in claim 34 further including the step of driving the displacer cylinders from separate hydraulic fluid pressure means operatively connected to the displacer cylinders.

36. The method as set forth in claim 34 further comprising the steps of:

providing a source of hydraulic fluid to a hydraulic motor; and causing the discharged high pressure working fluid from the heat exchanger to transmit a high pressure to the hydraulic fluid for driving the hydraulic motor and thereby providing mechanical energy.

37. A method of converting thermal energy into mechanical energy in a heat engine utilizing a liquid working fluid which remains in a substantially liquid state throughout a complete cycle of the heat engine; said method comprising the steps of:

providing a heat exchanger to receive high temperature low pressure working fluid and low temperature high pressure working fluid for flow through the heat exchanger in separate paths and discharge of the low pressure working fluid therefrom at a low temperature and discharge of the high pressure working fluid therefrom at a high temperature;

supplying the discharged low pressure working fluid and discharged high pressure working fluid in alternating relation to a pair of displacer cylinders having opposed cycles, one cylinder alternately receiving and displacing low pressure working fluid and the other cylinder simultaneously and alternately receiving and displacing high pressure working fluid thereby to provide a continuous displacement of high pressure working fluid and low pressure working fluid from the pair of cylinders in alternating relation;

driving the displacer cylinders from separate hydraulic fluid pressure means operatively connected to the displacer cylinders;

and causing the discharged high pressure working fluid to drive means for providing mechanical energy.

38. The method as set forth in claim 37 including the steps of:

heating the high pressure working fluid discharged from the heat exchanger and cooling the low pressure working fluid discharged from the heat exchanger before being supplied to the pair of displacer cylinders.

39. The method as set forth in claim 37 wherein said liquid working fluid has a maximum temperature at least around 25° F. below its critical temperature.

40. An apparatus for converting thermal energy into mechanical energy comprising:

a heat exchanger having a plurality of thin generally rectangular plates arranged in face-to-face tightly abutting contact and including separate adjacent flow paths therethrough for high pressure working fluid and low pressure working fluid to effect a transfer of heat to the high pressure fluid, said heat exchanger receiving high temperature low pressure working fluid and low temperature high pressure working fluid, and discharging low temperature low pressure working fluid and high temperature high pressure working fluid;

a heater receiving high temperature high pressure working fluid from the heat exchanger for increasing the temperature thereof;

a cooler receiving the low temperature low pressure working fluid from the heat exchanger for decreasing the temperature thereof;

a pair of displacer cylinders in opposed cycling relation to each other and alternating between low pressure working fluid from said cooler and high pressure working fluid from said heater, one cylinder receiving and displacing low pressure working fluid and the other cylinder simultaneously receiving and discharging high pressure working fluid thereby to provide a continuous displacement of high pressure working fluid and low pressure working fluid from the pair of cylinders in alternating relation; and power output means to provide mechanical energy being driven by and in response to the supply of high temperature high pressure working fluid from said heater and reciprocation of said cylinders.

41. An apparatus as set forth in claim 40 wherein supplemental means are provided to drive said displacer cylinders comprising a hydraulic cylinder for each displacer cylinder.

42. An apparatus as set forth in claim 40 wherein said power output means comprises a hydraulic fluid motor driven by hydraulic fluid pressurized from the output of high temperature high pressure working fluid from said heater.

* * * * *